US011112726B2

(12) United States Patent
Soda

(10) Patent No.: US 11,112,726 B2
(45) Date of Patent: Sep. 7, 2021

(54) IMAGE FORMING APPARATUS

(71) Applicant: KYOCERA Document Solutions Inc., Osaka (JP)

(72) Inventor: Tomohisa Soda, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/143,266

(22) Filed: Jan. 7, 2021

(65) Prior Publication Data

US 2021/0223716 A1 Jul. 22, 2021

(30) Foreign Application Priority Data

Jan. 17, 2020 (JP) ..... JP2020-005986

(51) Int. Cl.
*G03G 15/08* (2006.01)

(52) U.S. Cl.
CPC ..... *G03G 15/0868* (2013.01); *G03G 15/0891* (2013.01); *G03G 15/0879* (2013.01)

(58) Field of Classification Search
CPC ..... G03G 15/0868; G03G 15/0891; G03G 15/0879; G03G 15/0872; G03G 2215/0665; G03G 2215/0685
See application file for complete search history.

(56) References Cited

U.S. PATENT DOCUMENTS

2016/0306318 A1* 10/2016 Tomita ..... G03G 15/0879
2019/0086832 A1* 3/2019 Nohara ..... G03G 15/0879
2019/0086835 A1* 3/2019 Nohara ..... G03G 15/0868
2019/0187602 A1* 6/2019 Nohara ..... G03G 15/0879

FOREIGN PATENT DOCUMENTS

JP 2019-109326 7/2019

* cited by examiner

*Primary Examiner* — Sandra Brase
(74) *Attorney, Agent, or Firm* — Lex IP Meister, PLLC

(57) ABSTRACT

Toner replenishment units include an upper toner container, a lower toner container, a first vertical conveyance pipe, a second vertical conveyance pipe, a third vertical conveyance pipe, a first horizontal conveyance pipe, a second horizontal conveyance pipe, and a confluence section. A first conveyance screw is included in the horizontal conveyance pipe and a second conveyance screw is included in the second horizontal conveyance pipe. A first inter-axis distance between a first horizontal rotation axis of the first conveyance screw and a third vertical pipe axis of the third vertical conveyance pipe, and a second inter-axis distance between a second horizontal rotation axis of the second conveyance screw and the third vertical pipe axis are set to take a different value.

9 Claims, 10 Drawing Sheets

IMAGE FORMING APPARATUS

INCORPORATION BY REFERENCE

This application is based upon, and claims the benefit of priority from, corresponding Japanese Patent Application No. 2020-005986 filed in the Japan Patent Office on Jan. 17, 2020, the entire contents of which are incorporated herein by reference.

BACKGROUND

Field of the Invention

The present disclosure relates to an image forming apparatus that forms an image on a sheet.

Description of Related Art

Typically, an image forming apparatus such as a printer or a copying machine that employs an electrophotographic method includes a photosensitive drum that carries an electrostatic latent image and a developing device that supplies toner to the photosensitive drum and reveals the electrostatic latent image in a toner image.

SUMMARY

An image forming apparatus according to one aspect of the present disclosure includes a plurality of image forming units that include a photosensitive drum being able to rotate about a horizontally extending drum axis and a developing device supplying toner to the photosensitive drum, and to be arranged along an arrangement direction horizontally orthogonal to the drum axis, and a plurality of toner replenishment units provided corresponding to each of the plurality of image forming units and replenishing toner to the developing device. Each of the plurality of toner replenishment units includes first and second containers, first, second and third vertical conveyance pipes, first and second horizontal conveyance pipes, first and second conveyance members, a confluence section, and a conveyance driver. The first and second containers are able to store toner inside and discharge the toner. The first vertical conveyance pipe is formed in a tubular shape having a peripheral wall surrounding a first vertical pipe axis extending vertically downward from the first container, and guides the toner discharged from the first container vertically downward along the first vertical pipe axis. The second vertical conveyance pipe is formed in a tubular shape having a peripheral wall surrounding a second vertical pipe axis extending vertically downward from the second container, and guides the toner discharged from the second container vertically downward along the second vertical pipe axis. The first horizontal conveyance pipe is formed in a tubular shape extending in a first horizontal direction intersecting the drum axis and the arrangement direction and includes a first inflow port connected to a lower end of the first vertical conveyance pipe for toner to flow in. The second horizontal conveyance pipe is formed in a tubular shape extending in a second horizontal direction at an acute angle with respect to the first horizontal direction and includes a second inflow port connected to a lower end of the second vertical conveyance pipe for toner to flow in. The first conveyance member is disposed in the first horizontal conveyance pipe so as to be able to rotate about a first horizontal rotation axis along the first horizontal direction, and to convey the toner that has flowed into the first horizontal conveyance pipe through the first inflow port to a downstream side by rotation. The second conveyance member is disposed in the second horizontal conveyance pipe so as to be able to rotate about a second horizontal rotation axis along the second horizontal direction, and conveys the toner that has flowed into the second horizontal conveyance pipe through the second inflow port to a downstream side by rotation. The confluence section communicates with a downstream side portion of the first horizontal conveyance pipe and a downstream side portion of the second horizontal conveyance pipe respectively, receives the toner conveyed by the first conveyance member and the second conveyance member respectively inside, and includes a confluence discharge port discharging the received toner. The third vertical conveyance pipe is formed in a tubular shape having a peripheral wall surrounding a third vertical pipe axis extending vertically downward from the confluence discharge port and guides the toner discharged from the confluence section through the confluence discharge port toward the developing device vertically downward along the third vertical pipe axis. The conveyance driver generates a driving force to rotate the first conveyance member and the second conveyance member. In a plan view of the confluence section seen from a vertical direction, the confluence discharge port is disposed between the first horizontal rotation axis and the second horizontal rotation axis, and a first inter-axis distance between the first horizontal rotation axis and the third vertical pipe axis and a second inter-axis distance between the second horizontal rotation axis and the third vertical pipe axis are set to take a different value.

An image forming apparatus according to an other aspect of the present disclosure includes a plurality of image forming units that include a photosensitive drum being able to rotate about a horizontally extending drum axis and a developing device supplying toner to the photosensitive drum, and to be arranged along an arrangement direction horizontally orthogonal to the drum axis, and a plurality of toner replenishment units provided corresponding to each of the plurality of image forming units and that replenish toner to the developing device. Each of the plurality of toner replenishment units includes first and second containers, first, second and third vertical conveyance pipes, first and second horizontal conveyance pipes, first and second conveyance members, a confluence section, and a conveyance driver. The first and second containers are able to store toner inside and discharge the toner. The first vertical conveyance pipe is formed in a tubular shape having a peripheral wall surrounding a first vertical pipe axis extending vertically downward from the first container, and guides the toner discharged from the first container vertically downward along the first vertical pipe axis. The second vertical conveyance pipe is formed in a tubular shape having a peripheral wall surrounding a second vertical pipe axis extending vertically downward from the second container and guides the toner discharged from the second container vertically downward along the second vertical pipe axis. The first horizontal conveyance pipe is formed in a tubular shape extending in a first horizontal direction intersecting the drum axis and the arrangement direction and includes a first inflow port connected to a lower end of the first vertical conveyance pipe for toner to flow in. The second horizontal conveyance pipe is formed in a tubular shape extending in a second horizontal direction at an acute angle with respect to the first horizontal direction and includes a second inflow port connected to a lower end of the second vertical conveyance pipe for toner to flow in. The first conveyance member is disposed in the first horizontal conveyance pipe so as to be able to rotate about a first horizontal rotation axis along the first horizontal direction, and to convey the toner that has flowed into the first horizontal conveyance pipe through the first inflow port to a downstream side by rotation, a second conveyance member is disposed in the second horizontal conveyance pipe so as to be able to rotate about a second horizontal rotation axis along the second horizontal direction, and to convey the toner that has flowed into the second horizontal conveyance pipe through the second inflow port to a downstream side by rotation. The confluence section communicates with a downstream side portion of the first horizontal conveyance pipe and a downstream side portion of the second horizontal conveyance pipe respectively, receives the toner conveyed by the first conveyance member and the second conveyance member respectively inside, and includes a confluence discharge port discharging the received toner. The third vertical conveyance pipe is formed in a tubular shape having a peripheral wall surrounding a third vertical pipe axis extending vertically downward from the confluence discharge port and guides the toner discharged from the confluence section through the confluence discharge port toward the developing device vertically downward along the third vertical pipe axis. The conveyance driver generates a driving force to rotate the first conveyance member and the second conveyance member. In a plan view of the confluence section seen from a vertical direction, the confluence discharge port is disposed between the first horizontal rotation axis and the second horizontal rotation axis, and a first inter-axis distance between the first horizontal rotation axis and the third vertical pipe axis and a second inter-axis distance between the second horizontal rotation axis and the third vertical pipe axis are set to a same value. The first vertical conveyance pipe or the third vertical conveyance pipe of each of the plurality of toner replenishment units is disposed at a different position in a direction along the drum axis.

An image forming apparatus according to an other aspect of the present disclosure includes at least three image forming units including a photosensitive drum being able to rotate about a horizontally extending drum axis and a developing device supplying toner to the photosensitive drum, and to be arranged along an arrangement direction horizontally orthogonal to the drum axis, and at least three toner replenishment units provided corresponding to each of the at least three image forming units and that replenish toner to the developing device. Each of the at least three toner replenishment units includes first and second containers first, second and third vertical conveyance pipes, first and second horizontal conveyance pipes, first and second conveyance members, a confluence section, and a conveyance driver. The first and second containers are able to store toner inside and discharge the toner. The first vertical conveyance pipe is formed in a tubular shape having a peripheral wall surrounding a first vertical pipe axis extending vertically downward from the first container and guides the toner discharged from the first container vertically downward along the first vertical pipe axis. The second vertical conveyance pipe is formed in a tubular shape having a peripheral wall surrounding a second vertical pipe axis extending vertically downward from the second container and guides the toner discharged from the second container vertically downward along the second vertical pipe axis. The first horizontal conveyance pipe is formed in a tubular shape extending in a first horizontal direction intersecting the drum axis and the arrangement direction and includes a first inflow port connected to a lower end of the first vertical conveyance pipe for toner to flow in. The second horizontal conveyance pipe is formed in a tubular shape extending in a second horizontal direction at an acute angle with respect to the first horizontal direction and includes a second inflow port connected to a lower end of the second vertical conveyance pipe for toner to flow in. The first conveyance member is disposed in the first horizontal conveyance pipe so as to be able to rotate about a first horizontal rotation axis along the first horizontal direction, and to convey the toner that has flowed into the first horizontal conveyance pipe through the first inflow port to a downstream side by rotation. The second conveyance member is disposed in the second horizontal conveyance pipe so as to be able to rotate about a second horizontal rotation axis along the second horizontal direction, and to convey the toner that has flowed into the second horizontal conveyance pipe through the second inflow port to a downstream side by rotation. The confluence section communicates with a downstream side portion of the first horizontal conveyance pipe and a downstream side portion of the second horizontal conveyance pipe respectively, receives the toner conveyed by the first conveyance member and the second conveyance member respectively inside, and includes a confluence discharge port discharging the received toner. The third vertical conveyance pipe is formed in a tubular shape having a peripheral wall surrounding a third vertical pipe axis extending vertically downward from the confluence discharge port and guides the toner discharged from the confluence section through the confluence discharge port toward the developing device vertically downward along the third vertical pipe axis. The conveyance driver generates a driving force to rotate the first conveyance member and the second conveyance member. In a plan view of the confluence section seen from a vertical direction, the confluence discharge port is disposed between the first horizontal rotation axis and the second horizontal rotation axis, and a first inter-axis distance between the first horizontal rotation axis and the third vertical pipe axis and a second inter-axis distance between the second horizontal rotation axis and the third vertical pipe axis are set to a same value. In the at least three toner replenishment units, a pitch between the first vertical conveyance pipes adjacent to each other in the arrangement direction or a pitch between the third vertical conveyance pipes in the arrangement direction is set to a different value.

DETAILED DESCRIPTION

Hereafter, an image forming apparatus according to an embodiment of the disclosure will be described in detail on the basis of the drawings. In this embodiment, a tandem type color printer is illustrated as an example of the image forming apparatus. The image forming apparatus may be, for example, a copying machine, a fax machine, or a multifunction machine of these.

Figure 1:
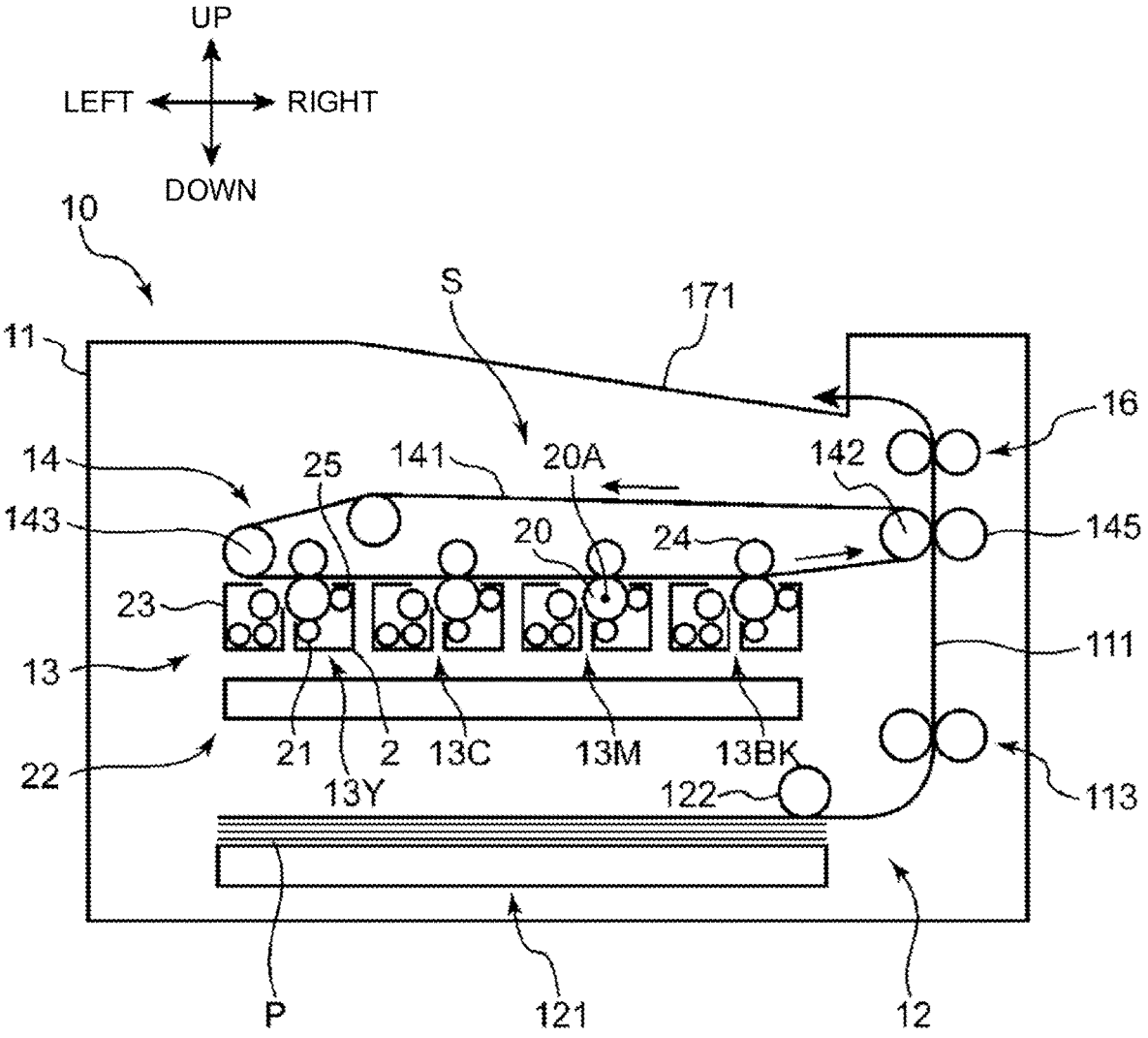
FIG. 1 is a cross-sectional view illustrating the internal structure of an image forming apparatus according to an embodiment of the present disclosure.

FIG. 1 is a cross-sectional view illustrating the internal structure of an image forming apparatus 10. The image forming apparatus 10 includes an apparatus main body 11 having a box-shaped housing structure. In the apparatus main body 11, a paper feeder 12 that feeds a sheet P, an image forming unit 13 that forms a toner image for transferring to the sheet P fed from the paper feeder 12, an intermediate transfer unit 14 to which the toner image is primarily transferred, a secondary transfer roller 145, and a fixer 16 that performs a process to fix the unfixed toner image formed on the sheet P to the sheet P are installed. Furthermore, a paper ejector 171 is provided on the upper part of the apparatus main body 11 to eject the sheet P that has been subjected to the fixing process by the fixer 16.

In the apparatus main body 11, a sheet conveyance path 111 extending in the vertical up-down direction is further formed on the right side of the image forming unit 13. The sheet conveyance path 111 is provided with a conveyance roller pair that conveys the sheet P in place. In addition, a resist roller pair 113 that performs skew correction of the sheet P and feeds the sheet P to the nip section of the secondary transfer described later at a specific timing is also provided on the upstream side of the nip section in the sheet conveyance path 111. The sheet conveyance path 111 is a conveyance path that conveys the sheet P from the paper feeder 12 to the paper ejector 171 via the image forming unit 13 (secondary transfer nip section) and the fixer 16.

The paper feeder 12 includes a paper feed tray 121 and a pick-up roller 122. The paper feed tray 121 is detachably mounted in the lower position of the apparatus main body 11 and stores a sheet bundle in which a plurality of sheets P are stacked. The pick-up roller 122 feeds out the sheet P on the uppermost surface of the sheet bundle stored in the paper feed tray 121 one by one.

The image forming unit 13 forms a toner image to be transferred to the sheet P, and a plurality of (at least three) units are provided to form a toner image of different colors. As a plurality of image forming units 13, in the present embodiment, in the arrangement direction from the upstream side to the downstream side in the rotation direction of the intermediate transfer belt 141 described later (from the left side to the right side illustrated in FIG. 1), a first image forming unit 13Y using yellow (Y) color toner, a second image forming unit 13C using cyan (C) color toner, a third image forming unit 13M using magenta (M) color toner, and a fourth image forming unit 13BK using black (BK) color toner are included being arranged in accordance with the toners of a plurality of colors. In other words, the first to fourth image forming units 13Y, 13C, 13M, and 13BK as the plurality of image forming units 13 are arranged in the arrangement direction (right-left direction) horizontally orthogonal to a drum axis 20A of a photosensitive drum 20 described later. The first to fourth image forming units 13Y, 13C, 13M, and 13BK have the same configuration except that the toner colors are different, and thus they are sometimes collectively referred to as the image forming unit 13. Each image forming unit 13 includes a photosensitive drum 20, and a charging device 21, a developing device 23, and a cleaning device 25 that are disposed around the photosensitive drum 20, respectively. In addition, an exposure device 22 common to each image forming unit 13 is disposed below the image forming unit 13.

The photosensitive drum 20 is rotationally driven about a specific drum axis 20A extending horizontally (front-rear direction), allows an electrostatic latent image to be formed on the peripheral surface thereof, and carries a toner image. The charging device 21 uniformly charges the surface of the photosensitive drum 20. The exposure device 22 includes various optical system devices such as a light source, a polygon mirror, a reflection mirror, and a deflection mirror, and irradiates the peripheral surface of the uniformly charged photosensitive drum 20 with light modulated on the basis of image data to form an electrostatic latent image. The cleaning device 25 cleans the peripheral surface of the photosensitive drum 20 after the toner image is transferred. In the present embodiment, the photosensitive drum 20, the charging device 21, and the cleaning device 25 are integrated with each other to form a drum unit 2 (FIG. 1).

The developing device 23 supplies toner to the peripheral surface of the photosensitive drum 20 in order to develop (reveal) the electrostatic latent image formed on the photosensitive drum 20. The developing device 23 contains a magnetic one-component toner as a developer. In this embodiment, the toner has the property of being charged to the plus polarity. In addition, in an other embodiment, an other developing method such as a two-component developer method including toner and a carrier or a non-magnetic one-component method may be employed for the developing device 23.

The intermediate transfer unit 14 is disposed above each image forming unit 13. The intermediate transfer unit 14 includes an intermediate transfer belt 141, a drive roller 142, a driven roller 143, and a primary transfer roller 24.

The intermediate transfer belt 141 is an endless belt-shaped rotating body, and is bridged over the drive roller 142 and the driven roller 143 in such a manner that the peripheral surface side thereof abuts on the peripheral surface of each photosensitive drum 20. The intermediate transfer belt 141 is circularly driven in one direction and carries a toner image transferred from the photosensitive drum 20 on the surface.

The drive roller 142 stretches the intermediate transfer belt 141 on the left end side of the intermediate transfer unit 14 and circularly drives the intermediate transfer belt 141. The drive roller 142 includes a metal roller. The driven roller 143 stretches the intermediate transfer belt 141 on the right end side of the intermediate transfer unit 14. The driven roller 143 applies tension to the intermediate transfer belt 141.

The primary transfer roller 24 sandwiches the intermediate transfer belt 141 with the photosensitive drum 20 to form a primary transfer nip section, and primarily transfers the toner image on the photosensitive drum 20 to the intermediate transfer belt 141. The primary transfer roller 24 is disposed facing the photosensitive drum 20 of each color.

The secondary transfer roller 145 is disposed facing the drive roller 142 with the intermediate transfer belt 141 sandwiched therebetween. The secondary transfer roller 145 is pressed against the peripheral surface of the intermediate transfer belt 141 to form a secondary transfer nip section. The toner image primarily transferred onto the intermediate transfer belt 141 is secondarily transferred to the sheet P fed from the paper feeder 12 at the secondary transfer nip section. The intermediate transfer unit 14 and the secondary transfer roller 145 of the present embodiment constitute a transferer. The transferer transfers the toner image formed in each image forming unit 13 from each photosensitive drum 20 to the sheet P.

The sheet P fed to the fixer 16 is heated and pressurized by passing through the fixing nip section. As a result, the toner image transferred to the sheet P at the secondary transfer nip section is fixed to the sheet P.

The paper ejector 171 is formed by denting the top of the apparatus main body 11. The sheet P that has been subjected to the fixing process is ejected to the paper ejector 171 via the sheet conveyance path 111 that extends from the upper part of the fixer 16.

Figure 2:
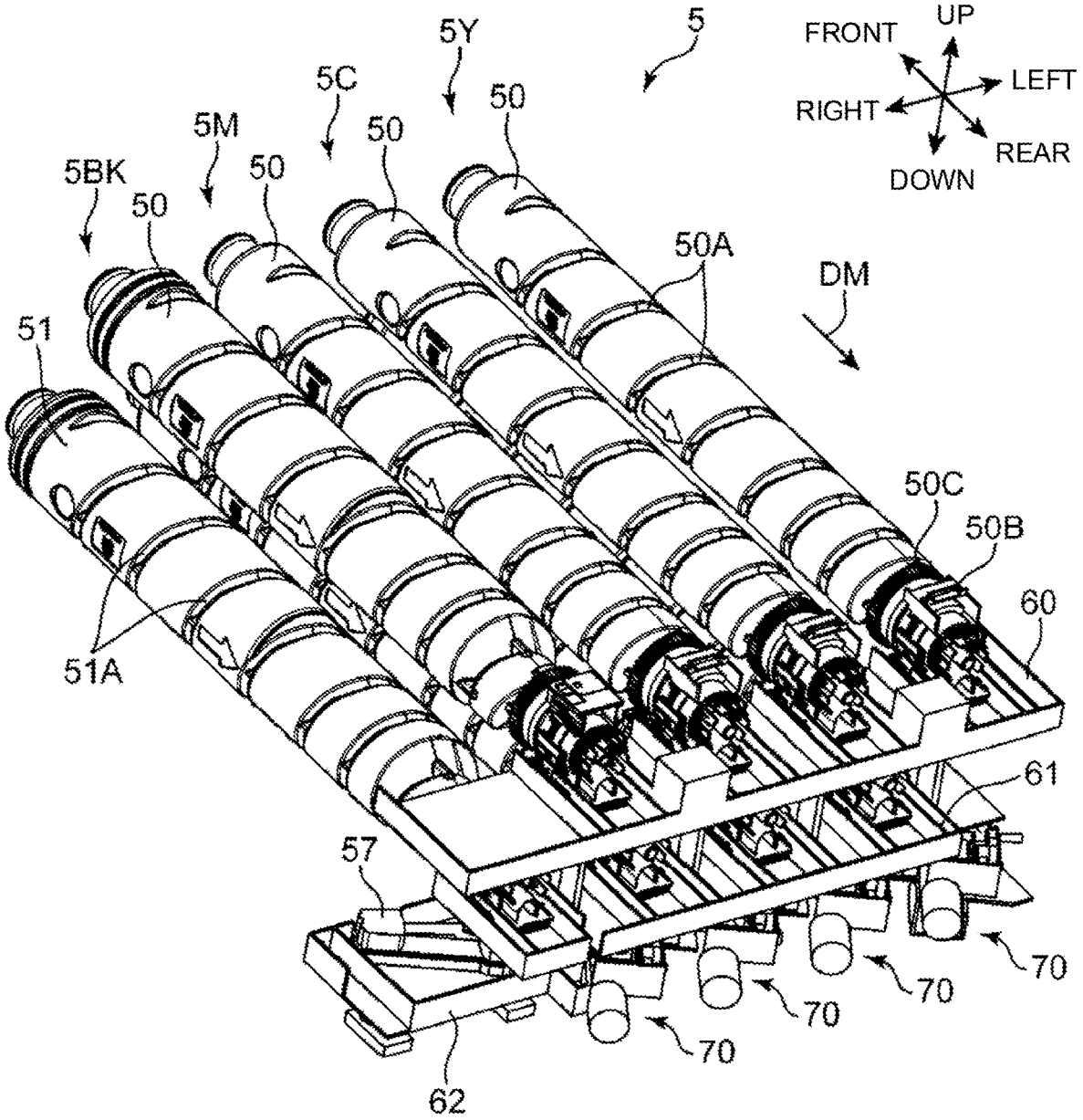
FIG. 2 is a perspective view of a toner replenishment unit included in the image forming apparatus.
Figure 3:
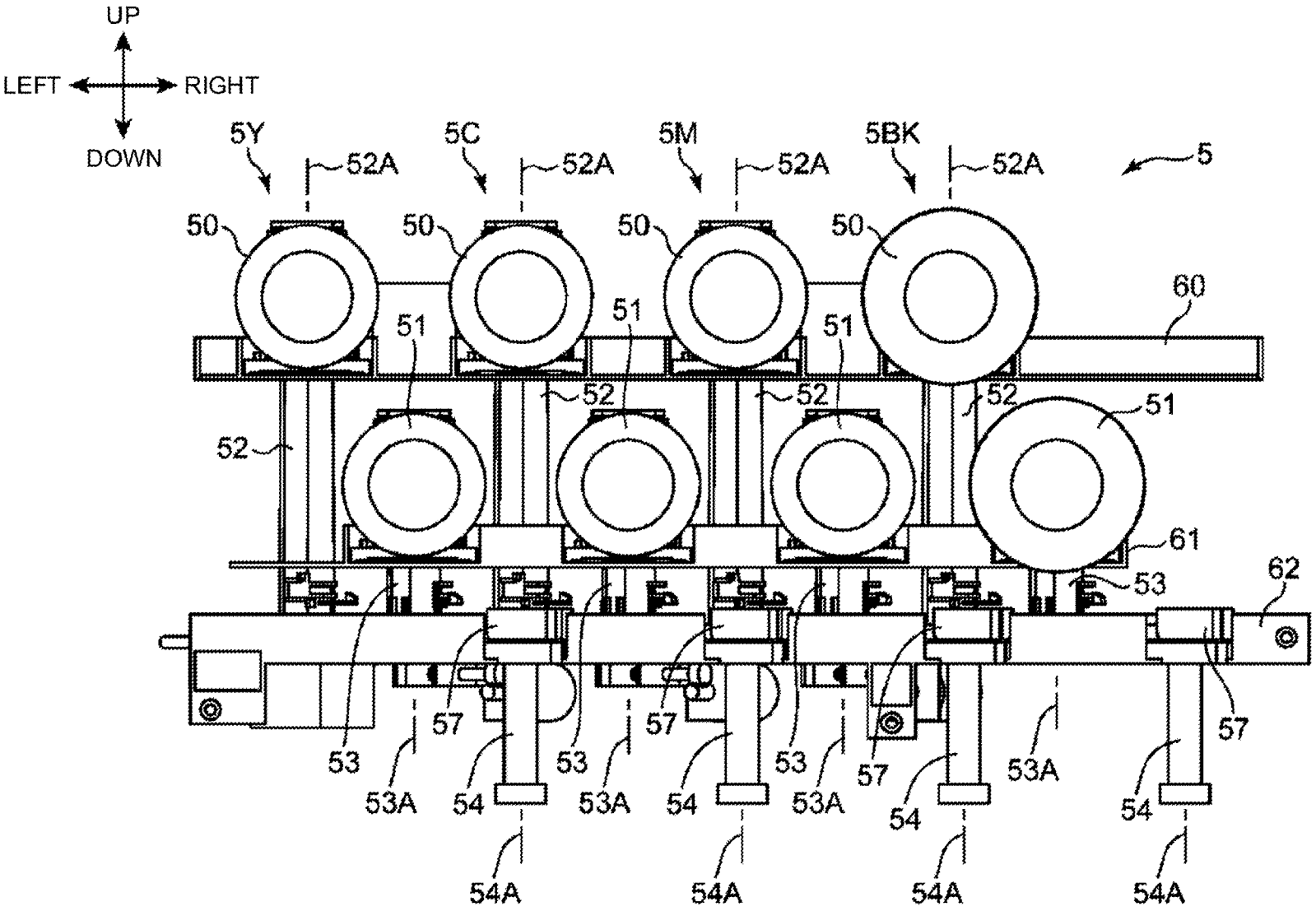
FIG. 3 is a front view of the toner replenishment unit.
Figure 4:
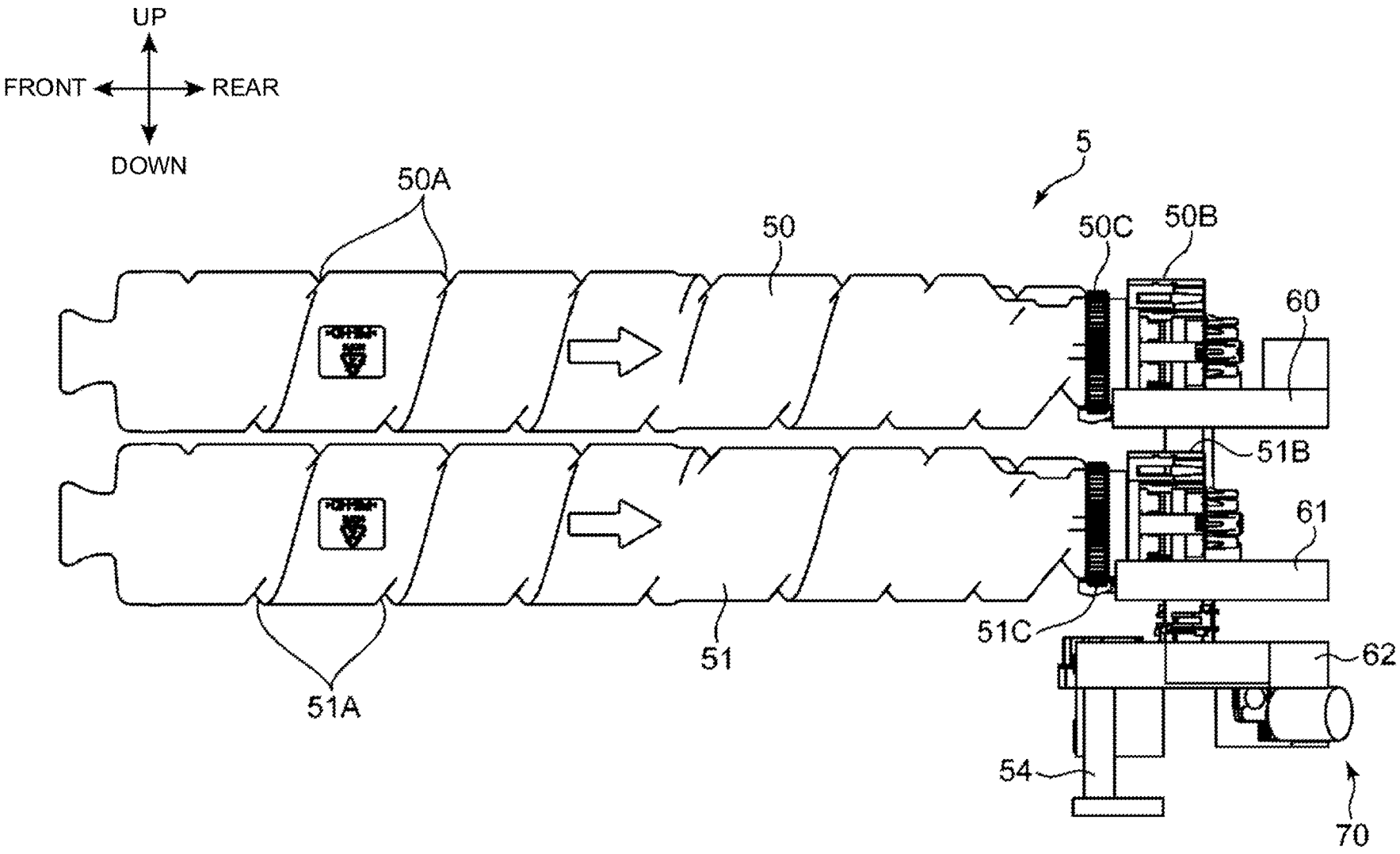
FIG. 4 is a side view of the toner replenishment unit.
Figure 5:
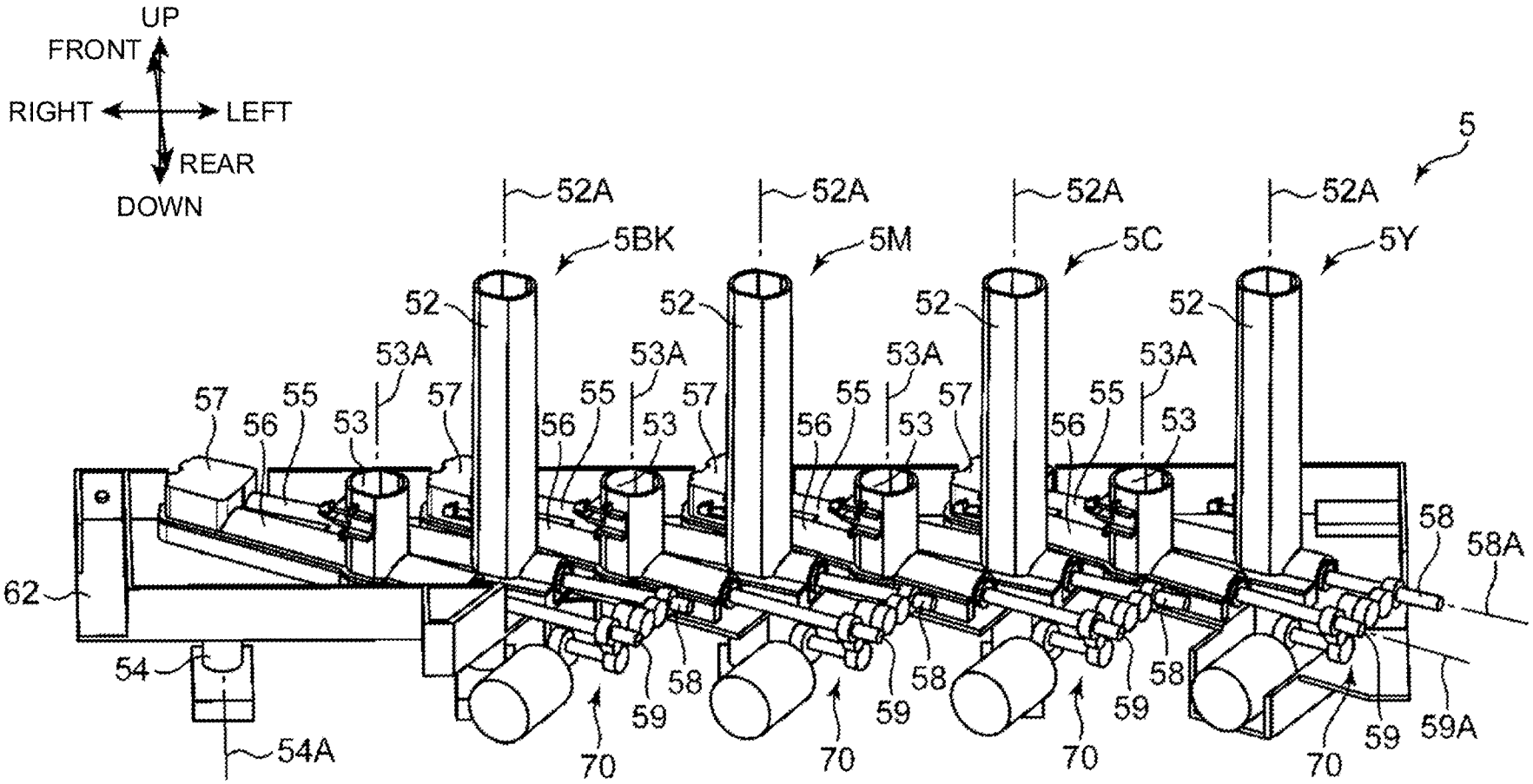
FIG. 5 is a perspective view of the toner replenishment unit in a state where a toner container is removed.
Figure 6:
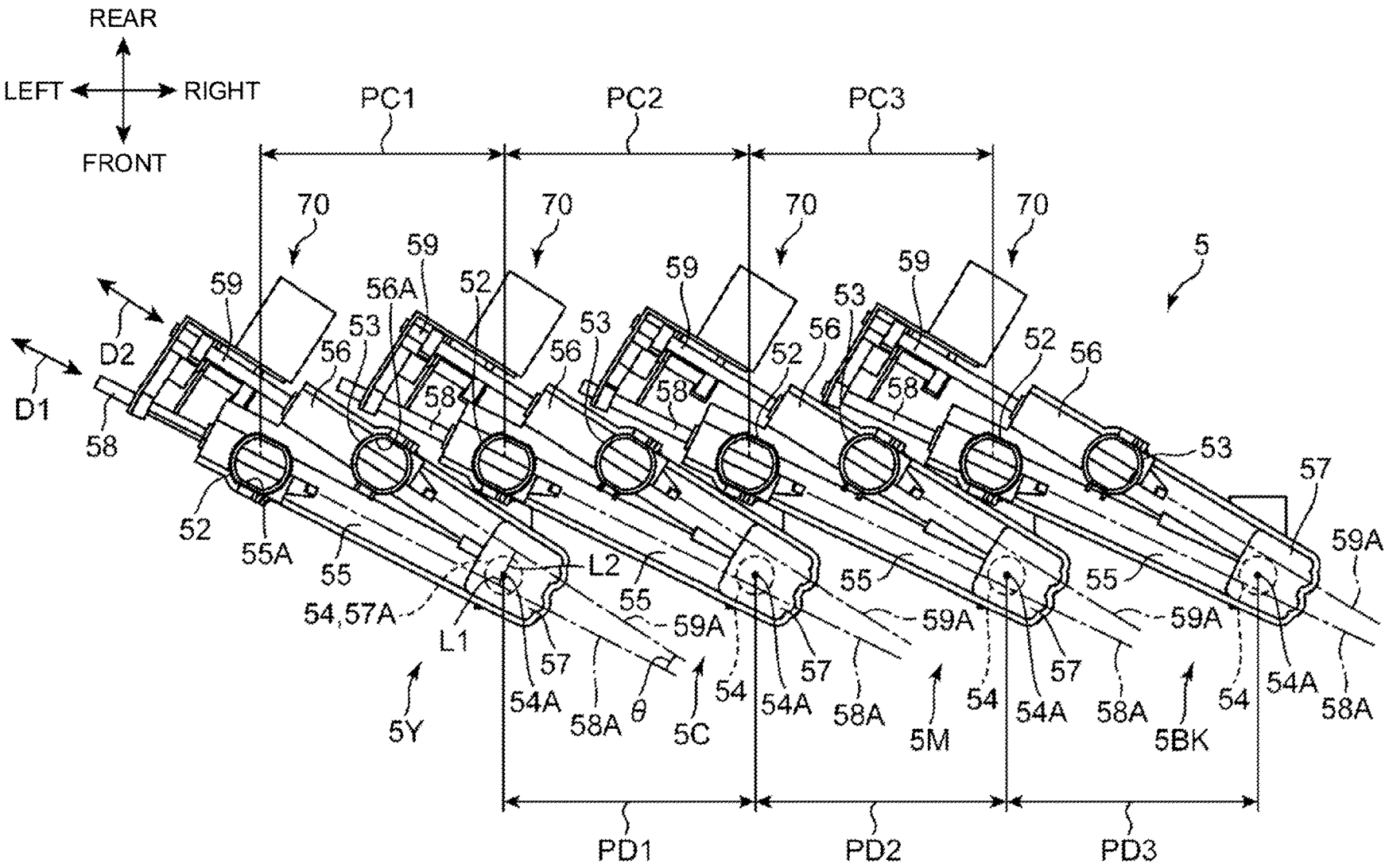
FIG. 6 is a view of the toner replenishment unit in a state where the toner container is removed, as viewed from above.

FIGS. 2 to 4 are views illustrating a toner replenishment unit 5 included in the image forming apparatus 10. FIG. 2 is a perspective view, FIG. 3 is a front view, and FIG. 4 is a side view. In addition, FIGS. 5 and 6 are views illustrating a state where toner containers 50 and 51 are removed in the toner replenishment unit 5. FIG. 5 is a perspective view, and FIG. 6 is a view seen from above.

The image forming apparatus 10 further includes a plurality of (at least three) toner replenishment units 5 provided corresponding to each of the plurality of image forming units 13. In the present embodiment, as a plurality of toner replenishment units 5, a first toner replenishment unit 5Y corresponding to the first image forming unit 13Y, a second toner replenishment unit 5C corresponding to the second image forming unit 13C, a third toner replenishment unit 5M corresponding to the third image forming unit 13M, and a fourth toner replenishment unit 5BK corresponding to the fourth image forming unit 13BK are included. The first to fourth toner replenishment units 5Y, 5C, 5M, and 5BK as a plurality of toner replenishment units 5 are arranged along the arrangement direction (right-left direction) same as that of the image forming unit 13. The first to fourth toner replenishment units 5Y, 5C, 5M, and 5BK have the same configuration except that the colors of the toners used are different, and thus they are sometimes collectively referred to as the toner replenishment unit 5.

Each toner replenishment unit 5 is a unit for replenishing toner to the developing device 23 of the corresponding image forming unit 13. Each toner replenishment unit 5 includes an upper toner container 50 (first container) and a lower toner container 51 (second container), respectively.

The upper toner container 50 and the lower toner container 51 extend in the front-rear direction along the drum axis 20A of the photosensitive drum 20, and are capable of storing the toner inside and discharging the toner, respectively. The upper toner container 50 and the lower toner container 51 are mounted in the apparatus main body 11 along a mounting direction DM (rearward direction in FIG. 2) along the drum axis 20A of the photosensitive drum 20. In the present embodiment, the upper toner container 50 has a cylindrical shape, and a spiral groove 50A extending in a spiral shape along the axial direction is formed on the outer peripheral surface thereof. Similarly, the lower toner container 51 has a cylindrical shape, and a spiral groove 51A extending spiral shape along the axial direction is formed on the outer peripheral surface thereof. The spiral grooves 50A and 51A form a spiral shaped protrusion that protrudes into the space inside the upper toner container 50 and the lower toner container 51. In addition, by rotating the upper toner container 50 and the lower toner container 51, respectively, the toner inside is conveyed backward by the spiral shaped protrusion.

The upper toner container 50 is positioned by being supported by an upper container supporter 60 fixed to the apparatus main body 11, in a state of being mounted in the apparatus main body 11. The upper toner container 50 includes a fixed section 50B and a first container gear 50C. The fixed section 50B does not rotate, and the part of the upper toner container 50 in front of the fixed section 50B can rotate relative to the fixed section 50B. The first container gear 50C is a gear fixed to the outer peripheral portion of the upper toner container 50 in front of the fixed section 50B. By transmitting the rotational force to the first container gear 50C, the front portion of the upper toner container 50 rotates.

Similarly, the lower toner container 51 is also positioned by being supported by a lower container supporter 61 fixed to the apparatus main body 11, in a state of being mounted in the apparatus main body 11. The lower toner container 51 includes a fixed section 51B and a second container gear 51C. The fixed section 51B does not rotate, and the part of the lower toner container 51 in front of the fixed section 51B can rotate relative to the fixed section 51B. The second container gear 51C is a gear fixed to the outer peripheral portion of the lower toner container 51 in front of the fixed section 51B. By transmitting the rotational force to the second container gear 51C, the front portion of the lower toner container 51 rotates.

The upper toner container 50 includes a first toner discharge port (not illustrated) formed on the fixed section 50B on the tip side in the mounting direction DM, and the lower toner container 51 includes a second toner discharge port (not illustrated) formed on the fixed section 51B on the tip side in the mounting direction DM. Toner is discharged from these toner discharge ports. In addition, the upper toner container 50 and the lower toner container 51 include a shutter that shuts each toner discharge port. When the upper toner container 50 is mounted in the upper container supporter 60 and the lower toner container 51 is mounted in the lower container supporter 61, these shutters are slid to open each toner discharge port. The upper toner container 50 and the lower toner container 51 included in each of the plurality of toner replenishment units 5 are disposed in a container space S of the apparatus main body 11 in FIG. 1.

In addition, the upper toner container 50 and the lower toner container 51 are formed to have the same length. Furthermore, the upper toner container 50 and the lower toner container 51 are formed to have the same length for each of the plurality of toner replenishment units 5. That is, all the upper toner container 50 and the lower toner container 51 included in each of the plurality of toner replenishment units 5 are formed to have the same length.

In each toner replenishment unit 5, the upper toner container 50 is disposed above the lower toner container 51 so as to overlap a part of the lower toner container 51 in a plan view seen from the vertical direction (up-down direction). That is, when viewed from the front-rear direction along the drum axis 20A of the photosensitive drum 20, the upper toner container 50 and the lower toner container 51 of the plurality of toner replenishment units 5 are disposed in a staggered pattern. As a result, it is possible to prevent the width of each toner replenishment unit 5 from being increased in the horizontal direction (right-left direction), and to make the toner replenishment unit 5 compact.

Each toner replenishment unit 5 further includes a first vertical conveyance pipe 52, a second vertical conveyance pipe 53, a third vertical conveyance pipe 54, a first horizontal conveyance pipe 55, a second horizontal conveyance pipe 56, a confluence section 57, and a first conveyance screw 58 (first conveyance member), a second conveyance screw 59 (second conveyance member), and a conveyance driver 70.

The first vertical conveyance pipe 52 is a tubular body including a peripheral wall surrounding the first vertical pipe axis 52A extending vertically downward from the upper toner container 50. The first vertical pipe axis 52A is the central axis of the first vertical conveyance pipe 52. The first vertical conveyance pipe 52 communicates with the first toner discharge port formed in the fixed section 50B of the upper toner container 50 in a state where the upper toner container 50 is supported by the upper container supporter 60. Therefore, the first vertical conveyance pipe 52 guides the toner discharged from the upper toner container 50 vertically downward along the first vertical pipe axis 52A.

The second vertical conveyance pipe 53 is a tubular body including a peripheral wall surrounding the second vertical pipe axis 53A extending vertically downward from the lower toner container 51. The second vertical pipe axis 53A is the central axis of the second vertical conveyance pipe 53. The second vertical conveyance pipe 53 communicates with the second toner discharge port formed in the fixed section 51B of the lower toner container 51 in a state where the lower toner container 51 is supported by the lower container supporter 61. Therefore, the second vertical conveyance pipe 53 guides the toner discharged from the lower toner container 51 vertically downward along the second vertical pipe axis 53A.

As the upper toner container 50 is disposed above the lower toner container 51, the length of the first vertical conveyance pipe 52 along the first vertical pipe axis 52A is set to a value longer than the length along the second vertical pipe axis 53A of the second vertical conveyance pipe 53.

In addition, in each toner replenishment unit 5, the first vertical conveyance pipe 52 and the second vertical conveyance pipe 53 are disposed at the same position in the front-rear direction along the drum axis 20A. Therefore, the upper toner container 50 that communicates with the first vertical conveyance pipe 52 and the lower toner container 51 that communicates with the second vertical conveyance pipe 53 are disposed at a same position in the front-rear direction along the drum axis 20A. Furthermore, in the plurality of toner replenishment units 5, each of the first vertical conveyance pipes 52 and each of the second vertical conveyance pipes 53 are disposed at a same position in the front-rear direction along the drum axis 20A. That is, all the first vertical conveyance pipes 52 and the second vertical conveyance pipes 53 included in each of the plurality of toner replenishment units 5 are disposed at the same position in the front-rear direction along the drum axis 20A. Therefore, all the upper toner container 50 and the lower toner container 51 included in each of the plurality of toner replenishment units 5 are disposed at the same position in the front-rear direction along the drum axis 20A. As a result, in all the upper toner container 50 and the lower toner container 51 included in each of the plurality of toner replenishment units 5, the front ends and the rear ends are aligned in the front-rear direction. For this reason, the aesthetic appearance of the plurality of toner replenishment units 5 can be improved.

In addition, the pitch between the first vertical conveyance pipes 52 in the arrangement direction (right-left direction) and the pitch between the second vertical conveyance pipes 53 in the arrangement direction (right-left direction) are set to a same value between the adjacent toner replenishment units 5. More specifically with reference to FIG. 6, a pitch PC1 between the first vertical conveyance pipes 52 in the first toner replenishment unit 5Y and the second toner replenishment unit 5C, a pitch PC2 between the first vertical conveyance pipes 52 in the second toner replenishment unit 5C and the third toner replenishment unit 5M, and a pitch PC3 between the first vertical conveyance pipes 52 in the third toner replenishment unit 5M and the fourth toner replenishment unit 5BK are set to a same value. Therefore, between the adjacent toner replenishment units 5, the pitch between the upper toner containers 50 in the arrangement direction (first container pitch) is the same, and the pitch between the lower toner containers 51 in the arrangement direction (second container pitch) is the same. In other words, a plurality of upper toner containers 50 are disposed at an equal pitch along the arrangement direction, and a plurality of lower toner containers 51 are disposed at an equal pitch along the arrangement direction.

The first horizontal conveyance pipe 55 is a tubular body extending in a first horizontal direction D1 that intersects the arrangement direction (horizontal direction) of the drum axis 20A of the photosensitive drum 20 and the toner replenishment unit 5 on a horizontal plane. Therefore, the first horizontal conveyance pipe 55 extends in the first horizontal direction D1 intersecting the upper toner container 50 extending along the drum axis 20A. The first horizontal conveyance pipe 55 is connected to the lower end of the first vertical conveyance pipe 52 and includes a first inflow port 55A formed at the connecting portion. The toner discharged from the upper toner container 50 and falling in the first vertical conveyance pipe 52 flows into the first horizontal conveyance pipe 55 through the first inflow port 55A.

The second horizontal conveyance pipe 56 is a tubular body extending in a second horizontal direction D2 forming an acute angle with respect to the first horizontal direction D1. Therefore, the second horizontal conveyance pipe 56 extends in the second horizontal direction D2 intersecting the lower toner container 51 extending along the drum axis 20A. Specifically, the first horizontal conveyance pipe 55 and the second horizontal conveyance pipe 56 are disposed in a V shape in which the downstream side area portions are close to each other at the confluence section 57 in such a manner that the angle formed by each other is an acute angle. The second horizontal conveyance pipe 56 is connected to the lower end of the second vertical conveyance pipe 53 and includes a second inflow port 56A formed at the connecting portion. The toner discharged from the lower toner container 51 and falling in the second vertical conveyance pipe 53 flows into the second horizontal conveyance pipe 56 through the second inflow port 56A.

The first horizontal conveyance pipe 55 and the second horizontal conveyance pipe 56 are supported from below by the conveyance pipe supporter 62.

Figure 7:
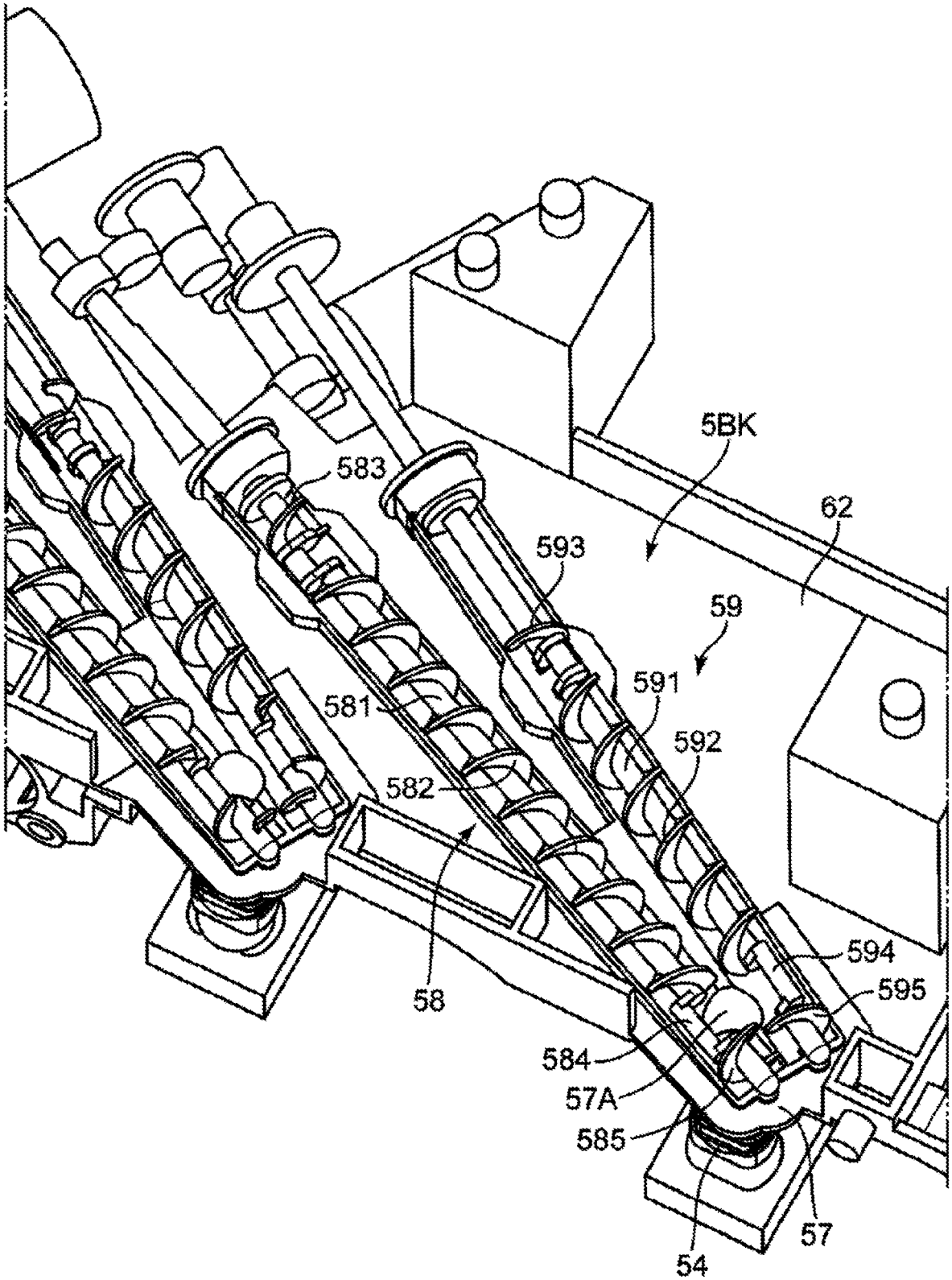
FIG. 7 is a perspective view of a first conveyance member and a second conveyance member included in the toner replenishment unit.

The first conveyance screw 58 is a conveyance member disposed in the first horizontal conveyance pipe 55 so as to be able to rotate about a first horizontal rotation axis 58A along the first horizontal direction D1. The first conveyance screw 58 conveys the toner that has flowed into the first horizontal conveyance pipe 55 through the first inflow port 55A to the downstream side toward the confluence section 57 by rotating about the first horizontal rotation axis 58A. The details of the first conveyance screw 58 will be described with reference to FIG. 7. The first conveyance screw 58 includes a first shaft 581, a first main conveyance blade 582, a first upstream side sub conveyance blade 583, a first paddle 584, and a first downstream side sub conveyance blade 585.

The first shaft 581 is a shaft that is disposed on the first horizontal rotation axis 58A and is rotated by the driving force of the conveyance driver 70 described later. The first main conveyance blade 582 is a spiral blade disposed on the first shaft 581 from a position directly below the first inflow port 55A of the first horizontal conveyance pipe 55 toward the confluence section 57. The first main conveyance blade 582 conveys toner to the downstream side toward the confluence section 57 by the rotation accompanying the rotation of the first shaft 581. The first upstream side sub conveyance blade 583 is a spiral blade disposed on the first shaft 581 on the upstream side of the first main conveyance blade 582 in the toner conveyance direction. The first upstream side sub conveyance blade 583 conveys toner in the same direction as that of the first main conveyance blade 582, and prevents the toner from being conveyed to the conveyance driver 70 side. The first paddle 584 is a paddle disposed in the confluence section 57 on the downstream side of the first main conveyance blade 582 on the first shaft 581 in the toner conveyance direction. The first paddle 584 sends out the toner conveyed from the first main conveyance blade 582 to the confluence section 57 to the confluence discharge port 57A by the rotation accompanying the rotation of the first shaft 581. The first downstream side sub conveyance blade 585 is a spiral blade disposed on the first shaft 581 on the downstream side of the first paddle 584 in the toner conveyance direction. The first downstream side sub conveyance blade 585 conveys toner in the direction opposite to that of the first main conveyance blade 582, thereby preventing the toner from entering the downstream end side of the first horizontal conveyance pipe 55.

The second conveyance screw 59 is a conveyance member disposed in the second horizontal conveyance pipe 56 so as to be able to rotate about a second horizontal rotation axis 59A along the second horizontal direction D2. The second conveyance screw 59 conveys the toner that has flowed into the second horizontal conveyance pipe 56 through the second inflow port 56A to the downstream side toward the confluence section 57 by rotating about the second horizontal rotation axis 59A. The details of the second conveyance screw 59 will be described with reference to FIG. 7. The second conveyance screw 59 includes a second shaft 591, a second main conveyance blade 592, a second upstream side sub conveyance blade 593, a second paddle 594, and a second downstream side sub conveyance blade 595.

The second shaft 591 is a shaft that is disposed on the second horizontal rotation axis 59A and is rotated by the driving force of the conveyance driver 70. The second main conveyance blade 592 is a spiral blade disposed on the second shaft 591 from a position directly below the second inflow port 56A of the second horizontal conveyance pipe 56 toward the confluence section 57. The second main conveyance blade 592 conveys the toner to the downstream side toward the confluence section 57 by the rotation accompanying the rotation of the second shaft 591. The second upstream side sub conveyance blade 593 is a spiral blade disposed on the second shaft 591 on the upstream side of the second main conveyance blade 592 in the toner conveyance direction. The second upstream side sub conveyance blade 593 conveys toner in the same direction as that of the second main conveyance blade 592, and prevents the toner from being conveyed to the conveyance driver 70 side. The second paddle 594 is a paddle disposed in the confluence section 57 on the downstream side of the second main conveyance blade 592 on the second shaft 591 in the toner conveyance direction. The second paddle 594 sends out the toner conveyed from the second main conveyance blade 592 to the confluence section 57 to the confluence discharge port 57A by the rotation accompanying the rotation of the second shaft 591. The second downstream side sub conveyance blade 595 is a spiral blade disposed on the second shaft 591 on the downstream side of the second paddle 594 in the toner conveyance direction. The second downstream side sub conveyance blade 595 conveys toner in the direction opposite to that of the second main conveyance blade 592, thereby preventing the toner from entering the downstream end side of the second horizontal conveyance pipe 56.

As described above, the first horizontal conveyance pipe 55 extends in the first horizontal direction D1, and the second horizontal conveyance pipe 56 extends in the second horizontal direction D2 forming an acute angle with respect to the first horizontal direction D1. Therefore, as illustrated in FIG. 6, the first conveyance screw 58 in the first horizontal conveyance pipe 55 and the second conveyance screw 59 in the second horizontal conveyance pipe 56 are disposed in a V shape in which the downstream side area portions are close to each other at the confluence section 57 with respect to the upstream side in such a manner that the angle θ formed by the first horizontal rotation axis 58A of the first conveyance screw 58 and the second horizontal rotation axis 59A of the second conveyance screw 59 is an acute angle. As a result, the toner conveyed by each of the first conveyance screw 58 and the second conveyance screw 59 can be efficiently merged at the confluence section 57.

The confluence section 57 communicates with the downstream side portion in the toner conveyance direction of the first horizontal conveyance pipe 55 and the downstream side portion in the toner conveyance direction of the second horizontal conveyance pipe 56, respectively. The confluence section 57 includes a circular confluence discharge port 57A. As illustrated in FIG. 6, the confluence discharge port 57A is disposed between the first horizontal rotation axis 58A and the second horizontal rotation axis 59A in a plan view of the confluence section 57 seen from the vertical direction. The confluence section 57 respectively receives the toner conveyed by the first conveyance screw 58 and the second conveyance screw 59 into the inside, and discharges the received toner through the confluence discharge port 57A.

The third vertical conveyance pipe 54 is a tubular body including a peripheral wall surrounding a third vertical pipe axis 54A extending vertically downward from the confluence discharge port 57A. The third vertical pipe axis 54A is the central axis of the third vertical conveyance pipe 54. One end of the third vertical conveyance pipe 54 is connected to the open end edge of the confluence discharge port 57A at the confluence section 57, and the other end is connected to the developing device 23. Therefore, the third vertical conveyance pipe 54 guides the toner discharged from the confluence section 57 through the confluence discharge port 57A toward the developing device 23 vertically downward along the third vertical pipe axis 54A.

In the plurality of toner replenishment units 5, each third vertical conveyance pipe 54 is disposed at the same position in the front-rear direction along the drum axis 20A. Therefore, the developing device 23 for each color communicating with each third vertical conveyance pipe 54 is disposed at the same position in the front-rear direction along the drum axis 20A.

In addition, the pitch between the third vertical conveyance pipe pipes 54 in the arrangement direction (right-left direction) is set to a same value between the adjacent toner replenishment units 5. More specifically with reference to FIG. 6, a pitch PD1 between the third vertical conveyance pipes 54 in the first toner replenishment unit 5Y and the second toner replenishment unit 5C, a pitch PD2 between the third vertical conveyance pipes 54 in the second toner replenishment unit 5C and the third toner replenishment unit 5M, and a pitch PD3 between the third vertical conveyance pipes 54 in the third toner replenishment unit 5M and the fourth toner replenishment unit 5BK are set to a same value. Therefore, the pitch (developing device pitch) in the arrangement direction between the adjacent developing devices 23 for each color is the same. In other words, the developing devices 23 for each color are disposed at an equal pitch along the arrangement direction.

Figure 8:
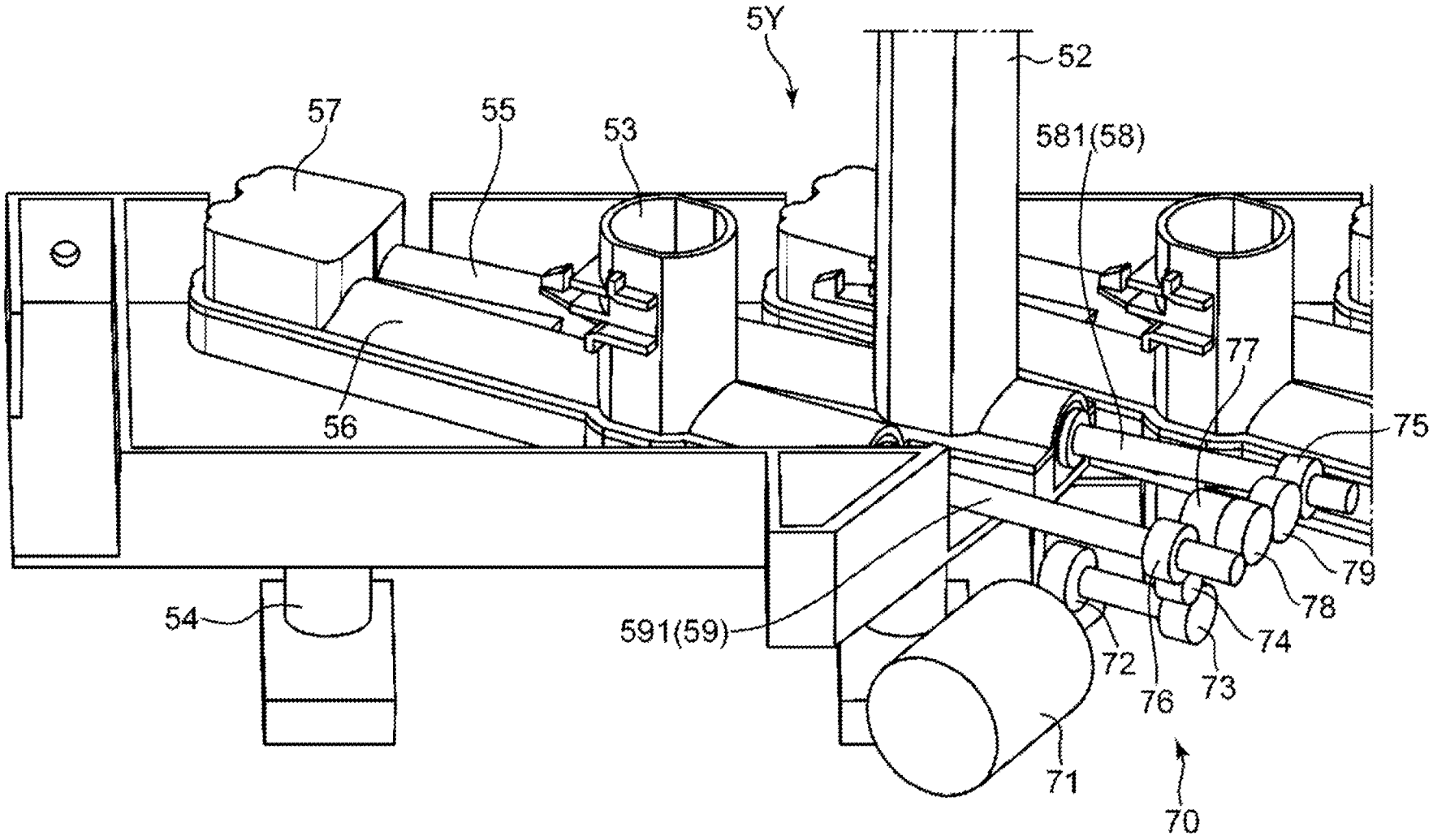
FIG. 8 is an enlarged perspective view illustrating the vicinity of a conveyance driver included in the toner replenishment unit.

The conveyance driver 70 generates a driving force for rotating the first conveyance screw 58 and the second conveyance screw 59. The conveyance driver 70 is disposed on the upstream side of the first horizontal conveyance pipe 55 and the second horizontal conveyance pipe 56 in the toner conveyance direction and on the opposite side of the confluence section 57. The details of the conveyance driver 70 will be described with reference to FIG. 8. The conveyance driver 70 includes a motor 71, and a drive transmission system including a warm wheel 72, a drive gear 73, a swing gear 74, a first input gear 75, a second input gear 76, a first transmission gear 77, a second transmission gear 78, and a third transmission gear 79.

The motor 71 is a brush motor that can rotate in a first rotation direction and a second rotation direction opposite to the first rotation direction. The motor 71 is disposed between the drive transmission systems in the adjacent toner replenishment units 5. For example, the motor 71 of the first toner replenishment unit 5Y is disposed between the drive transmission system of the first toner replenishment unit 5Y and the drive transmission system of the second toner replenishment unit 5C. The rotation, stop, and rotation direction of the motor 71 are controlled by a drive controller 801 of a controller 80 described later. The warm wheel 72 is coupled to the output shaft of the motor 71. In accordance with the rotation direction of the motor 71, the warm wheel 72 can also rotate in different rotation directions. The drive gear 73 is coaxially coupled to the warm wheel 72 and outputs the rotational driving force of the motor 71 via the warm wheel 72. The drive gear 73 can rotate in different rotation directions in accordance with the rotation direction of the motor 71.

The first input gear 75 is fixed to one end of the first shaft 581 of the first conveyance screw 58, and inputs the rotational driving force of the motor 71 to the first conveyance screw 58. The first input gear 75 is a taper-shaped conical gear that is inclined in accordance with the angle θ formed by the first horizontal rotation axis 58A and the second horizontal rotation axis 59A. The first input gear 75 meshes with the third transmission gear 79 which is a conical gear. The third transmission gear 79 meshes with the second transmission gear 78, and the first transmission gear 77 is disposed coaxially with the second transmission gear 78. The second input gear 76 is fixed to one end of the second shaft 591 of the second conveyance screw 59, and inputs the rotational driving force of the motor 71 to the second conveyance screw 59.

The swing gear 74 is disposed between the second input gear 76 and the first transmission gear 77 and meshes with the drive gear 73. The swing gear 74 can swing between a first position and a second position in accordance with the rotation direction of the drive gear 73, that is, in accordance with the rotation direction of the motor 71. The swing gear 74 meshes with the first transmission gear 77 at the first position and meshes with the second input gear 76 at the second position.

Suppose that the swing gear 74 swings to the first position and meshes with the first transmission gear 77 as the motor 71 is rotated in the first rotation direction. In this case, the rotational driving force of the motor 71 in the first rotation direction is transmitted to, in the order of the first transmission gear 77, the second transmission gear 78, and the third transmission gear 79. As a result, the first input gear 75 that meshes with the third transmission gear 79 rotates, and the first conveyance screw 58 rotates along with the rotation of the first input gear 75. That is, the swing gear 74 allows the rotation of the first conveyance screw 58 at the first position.

Meanwhile, suppose that the swing gear 74 swings to the second position and meshes with the second input gear 76 as the motor 71 is rotated in the second rotation direction. In this case, the rotational driving force of the motor 71 in the second rotation direction is transmitted to the second input gear 76. As a result, the second input gear 76 rotates, and the second conveyance screw 59 rotates along with the rotation of the second input gear 76. That is, the swing gear 74 allows the rotation of the second conveyance screw 59 at the second position.

By the swing gear 74 swinging in accordance with the rotation direction of the motor 71, the transmission of the rotational driving force to the first conveyance screw 58 and the second conveyance screw 59 is switched. This makes it possible to selectively rotate the first conveyance screw 58 and the second conveyance screw 59 with the use of the rotational driving force of a single motor 71. Therefore, the toner replenishment unit 5 can be achieved in a compact size and at low cost.

The conveyance driver 70 is not limited to the above configuration including the swing gear 74. For example, the conveyance driver 70 may have a configuration including a first one-way clutch provided on the first shaft 581 of the first conveyance screw 58 and a second one-way clutch provided on the second shaft 591 of the second conveyance screw 59. In this case, the first one-way clutch allows the rotation of the first conveyance screw 58 when the motor 71 is rotated in the first rotation direction, and at the same time regulates the rotation of the first conveyance screw 58 when the motor 71 is rotated in the second rotation direction. The second one-way clutch allows the rotation of the second conveyance screw 59 when the motor 71 is rotated in the second rotation direction, and at the same time regulates the rotation of the second conveyance screw 59 when the motor 71 is rotated in the first rotation direction. In the conveyance driver 70 having such a configuration, the transmission of the rotational driving force to the first conveyance screw 58 and the second conveyance screw 59 is switched by the one-way clutch in accordance with the rotation direction of the motor 71. This makes it possible to selectively rotate the first conveyance screw 58 and the second conveyance screw 59 with the use of the rotational driving force of a single motor 71. Therefore, the toner replenishment unit 5 can be achieved in a compact size and at low cost.

As described above, in the image forming apparatus 10 according to the present embodiment, the toner replenishment unit 5 is provided corresponding to each developing device 23 of each color. In each toner replenishment unit 5, the upper toner container 50 and the lower toner container 51 are disposed with respect to the developing device 23. The toner discharged from the upper toner container 50 flows into the first horizontal conveyance pipe 55 through the first vertical conveyance pipe 52, is conveyed to the confluence section 57 by the rotation of the first conveyance screw 58 disposed in the first horizontal conveyance pipe 55, and is replenished to the developing device 23 through the third vertical conveyance pipe 54 communicating with the confluence discharge port 57A. Meanwhile, the toner discharged from the lower toner container 51 flows into the second horizontal conveyance pipe 56 through the second vertical conveyance pipe 53, is conveyed to the confluence section 57 by the rotation of the second conveyance screw 59 disposed in the second horizontal conveyance pipe 56, and is replenished to the developing device 23 through the third vertical conveyance pipe 54 communicating with the confluence discharge port 57A. Even if one of the upper toner container 50 and the lower toner container 51 is emptied, it is possible to replenish the toner from the other container to the developing device 23. Thus, it is possible to reduce the frequency and time when the image formation operation is stopped due to the replacement of the container.

As described above, the first conveyance screw 58 and the second conveyance screw 59 are disposed in a V shape in which the downstream side area portions are close to each other at the confluence section 57 with respect to the upstream side in such a manner that the angle θ formed by the first horizontal rotation axis 58A of the first conveyance screw 58 and the second horizontal rotation axis 59A of the second conveyance screw 59 is an acute angle. As a result, the toner conveyed by each of the first conveyance screw 58 and the second conveyance screw 59 can be efficiently merged at the confluence section 57.

With reference to FIG. 6, suppose that, in the arrangement direction (right-left direction) of the plurality of toner replenishment units 5, the pitch between the adjacent developing devices 23 (developing device pitch) and the pitch between the upper toner containers 50 between the adjacent toner replenishment units 5 (first container pitch) are different. In this case, between the adjacent toner replenishment units 5, the pitches PC1, PC2, and PC3 between the first vertical pipe axes 52A of the first vertical conveyance pipes 52 communicating with the upper toner container 50, and the pitches PD1, PD2, and PD3 between the third vertical pipe axes 54A of the third vertical conveyance pipes 54 communicating with the developing device 23 are different. In this case, with regard to the positional relation at the confluence section 57 between the respective rotation axes 58A and 59A of the first conveyance screw 58 and the second conveyance screw 59 and the third vertical pipe axis 54A, if the position of the third vertical pipe axis 54A is set to the central position between the respective rotation axes 58A and 59A, the angle θ formed by the first conveyance screw 58 and the second conveyance screw 59 disposed in a V shape will be different for each toner replenishment unit 5 in accordance with the pitch deviation between the developing device pitch and the first container pitch.

Therefore, in each toner replenishment unit 5 according to the present embodiment, in a plan view of the confluence section 57 seen from the vertical direction, a first inter-axis distance L1 between the first horizontal rotation axis 58A and the third vertical pipe axis 54A and a second inter-axis distance L2 between the second horizontal rotation axis 59A and the third vertical pipe axis 54A are set to take a different value. That is, the position of the third vertical pipe axis 54A in the confluence section 57 is not the central position between the first horizontal rotation axis 58A and the second horizontal rotation axis 59A, but is eccentrically-located on either rotation axis side. The difference between the first inter-axis distance L1 and the second inter-axis distance L2 is set in accordance with the pitch deviation between the developing device pitch and the first container pitch, and is set to a larger value as the pitch deviation increases. As a result, the pitch deviation between the developing device pitch and the first container pitch is absorbed, and the angle θ formed by the first conveyance screw 58 and the second conveyance screw 59 disposed in a V shape can be made to coincide in the plurality of toner replenishment units 5. Therefore, the configuration of the conveyance driver 70 for driving the first conveyance screw 58 and the second conveyance screw 59, for example, the first input gear 75 and the third transmission gear 79 including a conical gear can be standardized in the plurality of toner replenishment units 5, and the cost can be reduced.

In addition, as described above, the length of the first vertical conveyance pipe 52 communicating with the upper toner container 50 is set to a value longer than the length of the second vertical conveyance pipe 53 communicating with the lower toner container 51. As the length of the vertical conveyance pipe increases, the compressive force applied to the toner accumulated in the vertical conveyance pipe increases, which may cause a phenomenon in which the fluidity of the toner decreases. If the toner with reduced fluidity in the first vertical conveyance pipe 52 flows into the first horizontal conveyance pipe 55 and is conveyed to the confluence section 57 by the first conveyance screw 58, it is assumed that the toner will not be properly discharged from the confluence discharge port 57A to the third vertical conveyance pipe 54.

In view of such an assumption, the first inter-axis distance L1 corresponding to the first conveyance screw 58 is set to a value shorter than the second inter-axis distance L2. As a result, the flow distance of the toner conveyed to the confluence section 57 by the first conveyance screw 58 from the first conveyance screw 58 to the confluence discharge port 57A can be shortened. Therefore, even if the fluidity of the toner in the first vertical conveyance pipe 52 decreases as the pipe length is set longer, the toner can be efficiently conveyed from the confluence discharge port 57A to the third vertical conveyance pipe 54.

In addition, the first inter-axis distance L1 is set to be equal to or less than the value obtained by adding the turning radius of the first paddle 584 provided in the first conveyance screw 58 to the opening radius of the confluence discharge port 57A. Similarly, the second inter-axis distance L2 is set to be equal to or less than the value obtained by adding the turning radius of the second paddle 594 provided in the second conveyance screw 59 to the opening radius of the confluence discharge port 57A. As a result, the frequency with which the toner conveyed to the confluence section 57 by the first conveyance screw 58 and the second conveyance screw 59 stays between the respective conveyance screws 58 and 59 and the confluence discharge port 57A is reduced. The toner can be efficiently discharged from the confluence discharge port 57A to the third vertical conveyance pipe 54 by the respective paddles 584 and 594.

The technical idea in which the first inter-axis distance L1 and the second inter-axis distance L2 are different values, and the first inter-axis distance L1 is set to a value shorter than the second inter-axis distance L2 is not limited to the application to an image forming apparatus 10 including four toner replenishment units 5 in accordance with four color toners. This technical idea may be applied to a monochrome image forming apparatus (such as a monochrome machine) including one toner replenishment unit 5. When the above technical idea is applied to a monochromatic image forming apparatus, even if the fluidity of the toner in the first vertical conveyance pipe 52 decreases due to the lengthening of the pipe length, the abovementioned effect of efficiently discharging the toner from the confluence discharge port 57A to the third vertical conveyance pipe 54 is maintained.

Figure 9:
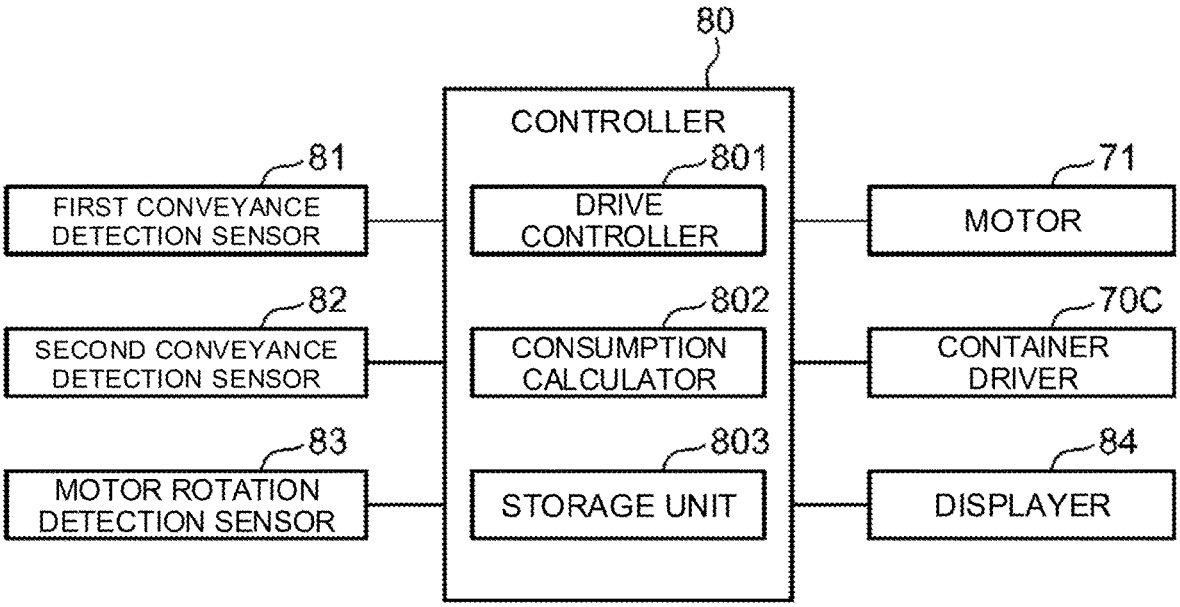
FIG. 9 is a block diagram of a controller of the image forming apparatus.

FIG. 9 is a block diagram of the controller 80 of the image forming apparatus 10. The image forming apparatus 10 includes the controller 80 that controls each toner replenishment unit 5. The controller 80 includes a central processing unit (CPU), a read only memory (ROM) for storing control programs, and a random access memory (RAM) used as a work area of the CPU. In addition to the motor 71 described above, the controller 80 is electrically connected to a container driver 70C, a first conveyance detection sensor 81, a second conveyance detection sensor 82, a motor rotation detection sensor 83, a displayer 84, and the like.

The displayer 84 is included in an operator (not illustrated) of the image forming apparatus 10. The displayer 84 displays the operation information and movement information of the image forming apparatus 10.

The first conveyance detection sensor 81, the second conveyance detection sensor 82, and the motor rotation detection sensor 83 are provided in each of the plurality of toner replenishment units 5. The first conveyance detection sensor 81 detects the rotation of the first conveyance screw 58. The structure of the first conveyance detection sensor 81 is not particularly limited. The first conveyance detection sensor 81 is provided, for example, in the first shaft 581 of the first conveyance screw 58, and can include a piece to be detected in which a plurality of slits are formed and a PI sensor that detects the detection light transmitted through the slits. In addition, the first conveyance detection sensor 81 may include an actuator provided in the first shaft 581 and a switch operated by the actuator.

The second conveyance detection sensor 82 detects the rotation of the second conveyance screw 59. The structure of the second conveyance detection sensor 82 is not particularly limited. The second conveyance detection sensor 82 is provided, for example, in the second shaft 591 of the second conveyance screw 59, and can include a piece to be detected in which a plurality of slits are formed and a PI sensor that detects the detection light transmitted through the slits. In addition, the second conveyance detection sensor 82 may include an actuator provided in the second shaft 591 and a switch operated by the actuator.

The motor rotation detection sensor 83 detects the rotation of the motor 71. The structure of the motor rotation detection sensor 83 is not particularly limited. The motor rotation detection sensor 83 is provided, for example, in the warm wheel 72 coupled to the motor 71, and can include a piece to be detected in which a plurality of slits are formed and a PI sensor that detects the detection light transmitted through the slits. In addition, the motor rotation detection sensor 83 may include an actuator provided on the warm wheel 72 and a switch operated by the actuator, and may be configured to detect fluctuations in a current supplied to the motor 71 by applying a periodic load to the actuator.

The controller 80 functions to include the drive controller 801, a consumption calculator 802, and a storage unit 803 by executing a control program stored in the ROM by the CPU.

The storage unit 803 stores in advance various threshold value information referred to by the drive controller 801 and the consumption calculator 802, and calculation information such as constants used in the calculation.

The drive controller 801 controls the drive of the motor 71 and the container driver 70C. The drive controller 801 switches between a first replenishment state for replenishing toner from the upper toner container 50 to the developing device 23 and a second replenishment state for replenishing toner from the lower toner container 51 to the developing device 23, in response to a toner replenishment request from the developing device 23.

In the first replenishment state, the drive controller 801 controls the container driver 70C to discharge the toner from the upper toner container 50 through the first vertical conveyance pipe 52, and at the same time rotationally drives the motor 71 in the first rotation direction in response to the replenishment request to rotate the first conveyance screw 58. In doing so, the rotation of the first conveyance screw 58 is detected by the first conveyance detection sensor 81, and the rotation of the motor 71 in the first rotation direction is detected by the motor rotation detection sensor 83.

Meanwhile, in the second replenishment state, the drive controller 801 controls the container driver 70C to discharge the toner from the lower toner container 51 through the second vertical conveyance pipe 53, and at the same time rotationally drives the motor 71 in the second rotation direction in response to the replenishment request to rotate the second conveyance screw 59. In doing so, the rotation of the second conveyance screw 59 is detected by the second conveyance detection sensor 82, and the rotation of the motor 71 in the second rotation direction is detected by the motor rotation detection sensor 83.

The consumption calculator 802 respectively calculates the cumulative value of the rotation amount (for example, rotation time) of the first conveyance screw 58 and the second conveyance screw 59 on the basis of the detection results of the first conveyance detection sensor 81 and the second conveyance detection sensor 82. In addition, the consumption calculator 802 calculates, for each screw, the cumulative value of the rotation amount (for example, rotation time) of the motor 71 when rotating the first conveyance screw 58 and the second conveyance screw 59, on the basis of the detection result of the motor rotation detection sensor 83. The consumption calculator 802 respectively calculates the flow rate of the toner flowing through the first horizontal conveyance pipe 55 and the second horizontal conveyance pipe 56 in accordance with the calculation result of each of the above rotation amounts, thereby respectively calculating the amount of toner consumed by the upper toner container 50 and the lower toner container 51.

The flow rate of the toner in the first horizontal conveyance pipe 55 and the second horizontal conveyance pipe 56 is calculated by the product of the cross-sectional area of each conveyance pipe, the number of rotations (rotation speed) of each conveyance screw, and the pitch of the spiral blades of the first main conveyance blade 582 and the second main conveyance blade 592. In doing so, toner is supplied from the upper toner container 50 and the lower toner container 51 to the first vertical conveyance pipe 52 and the second vertical conveyance pipe 53 at any time, and thus the first horizontal conveyance pipe 55 and the second horizontal conveyance pipe 56 are maintained in a state of being filled with the toner. Therefore, the flow rate of the toner is calculated accurately by the above product. Then, the calculated flow rate of the toner in the first horizontal conveyance pipe 55 or the second horizontal conveyance pipe 56 is multiplied by the cumulative value of each rotation amount (rotation time) to thereby calculate the toner consumption of the upper toner container 50 or the lower toner container 51. Information on the toner consumption calculated by the consumption calculator 802 is displayed on the displayer 84.

When a new upper toner container 50 and a new lower toner container 51 are mounted in the image forming apparatus 10, the consumption calculator 802 resets the cumulative value of each rotation amount. In order to obtain information on the mounting of the new upper toner container 50 and lower toner container 51, information on an RFID memory (not illustrated) included in each container may be referred to, or the information may be input by a user or a maintenance worker from an operator (not illustrated) of the image forming apparatus 10. In addition, the consumption calculator 802 displays the toner container empty information on the displayer 84 when the consumption of each toner container approaches the toner filling amount of the new toner container. As a result, the user can recognize that the toner container is almost empty or has become empty. As described above, when one of the upper toner container 50 and the lower toner container 51 becomes empty, the drive controller 801 switches the drive of the container driver 70C and the motor 71 in such a manner that the toner is supplied to the developing device 23 from the other toner container.

Figure 10:
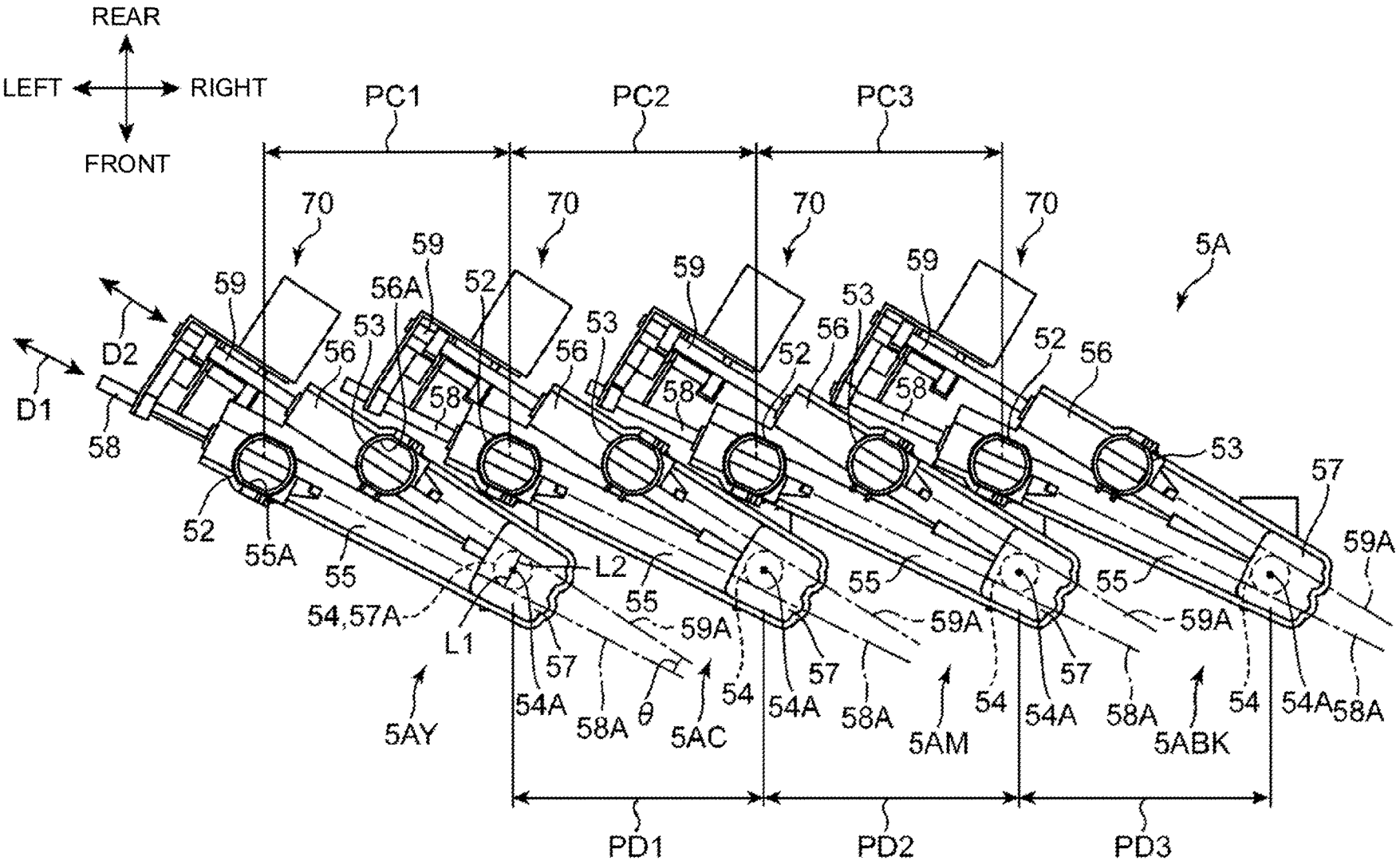
FIG. 10 is a view of a toner replenishment unit according to a modified embodiment of the present disclosure as viewed from above.

FIG. 10 is a view of a toner replenishment unit 5A according to a modified embodiment of the present disclosure as viewed from above. The toner replenishment unit applied to the image forming apparatus 10 is not limited to the abovementioned toner replenishment unit 5, and may be the toner replenishment unit 5A illustrated in FIG. 10. In this case, the image forming apparatus 10 includes a plurality of (at least three) toner replenishment units 5A provided corresponding to each of the plurality of image forming units 13. In the present modified embodiment, as a plurality of toner replenishment units 5A, a first toner replenishment unit 5AY corresponding to the first image forming unit 13Y, a second toner replenishment unit 5AC corresponding to the second image forming unit 13C, a third toner replenishment unit 5AM corresponding to the third image forming unit 13M, and a fourth toner replenishment unit 5ABK corresponding to the fourth image forming unit 13BK are included. The first to fourth toner replenishment units 5AY, 5AC, 5AM, and 5ABK as a plurality of toner replenishment units 5A are arranged along the arrangement direction (right-left direction) same as that of the image forming unit 13. The first to fourth toner replenishment units 5AY, 5AC, 5AM, and 5ABK have the same configuration except that the colors of the toners used are different, and thus they are sometimes collectively referred to as the toner replenishment unit 5A.

In the toner replenishment unit 5A, the positional relation at the confluence section 57 between the respective rotation axes 58A and 59A of the first conveyance screw 58 and the second conveyance screw 59 and the third vertical pipe axis 54A is different from that of the above toner replenishment unit 5. Specifically, in the toner replenishment unit 5A, in a plan view of the confluence section 57 seen from the vertical direction, a first inter-axis distance L1 between the first horizontal rotation axis 58A and the third vertical pipe axis 54A and a second inter-axis distance L2 between the second horizontal rotation axis 59A and the third vertical pipe axis 54A are set to a same value. That is, in the confluence section 57, the position of the third vertical pipe axis 54A is set to the central position between the first horizontal rotation axis 58A and the second horizontal rotation axis 59A. In this configuration, suppose that, in the arrangement direction (right-left direction) of the plurality of toner replenishment units 5A, the pitch between the adjacent developing devices 23 (developing device pitch) and the pitch between the upper toner containers 50 between the adjacent toner replenishment units 5A (first container pitch) are different. In this case, the angle θ formed by the first conveyance screw 58 and the second conveyance screw 59 disposed in a V shape differs for each toner replenishment unit 5A in accordance with the pitch deviation between the developing device pitch and the first container pitch.

In present modified embodiment, an aspect in which the angle θ formed by the first conveyance screw 58 and the second conveyance screw 59 disposed in a V shape is made to coincide in the plurality of toner replenishment units 5A is roughly divided into a first aspect and a second aspect. In the following, these first and second aspects will be described in sequence.

First, in the first aspect according to the present modified embodiment, the pitch between the first vertical conveyance pipes 52 in the arrangement direction (right-left direction) and the pitch between the second vertical conveyance pipes 53 in the arrangement direction (right-left direction) are set to a same value between the adjacent toner replenishment units 5A. More specifically with reference to FIG. 10, a pitch PC1 between the first vertical conveyance pipes 52 in the first toner replenishment unit 5AY and the second toner replenishment unit 5AC, a pitch PC2 between the first vertical conveyance pipes 52 in the second toner replenishment unit 5AC and the third toner replenishment unit 5AM, and a pitch PC3 between the first vertical conveyance pipes 52 in the third toner replenishment unit 5AM and the fourth toner replenishment unit 5ABK are set to a same value. Therefore, between the adjacent toner replenishment units 5A, the pitch between the upper toner containers 50 in the arrangement direction (first container pitch) is the same, and the pitch between the lower toner containers 51 in the arrangement direction (second container pitch) is the same. In other words, a plurality of upper toner containers 50 are disposed at an equal pitch along the arrangement direction, and a plurality of lower toner containers 51 are disposed at an equal pitch along the arrangement direction.

In addition, the pitch between the third vertical conveyance pipe pipes 54 in the arrangement direction (right-left direction) is set to a same value between the adjacent toner replenishment units 5A. More specifically with reference to FIG. 10, a pitch PD1 between the third vertical conveyance pipes 54 in the first toner replenishment unit 5AY and the second toner replenishment unit 5AC, a pitch PD2 between the third vertical conveyance pipes 54 in the second toner replenishment unit 5AC and the third toner replenishment unit 5AM, and a pitch PD3 between the third vertical conveyance pipes 54 in the third toner replenishment unit 5AM and the fourth toner replenishment unit 5ABK are set to a same value. Therefore, the pitch (developing device pitch) in the arrangement direction between the adjacent developing devices 23 for each color is the same. In other words, the developing devices 23 for each color are disposed at an equal pitch along the arrangement direction.

Furthermore, in each toner replenishment unit 5A, the first vertical conveyance pipe 52 and the second vertical conveyance pipe 53 are disposed at the same position in the front-rear direction along the drum axis 20A. Therefore, the upper toner container 50 that communicates with the first vertical conveyance pipe 52 and the lower toner container 51 that communicates with the second vertical conveyance pipe 53 are disposed at a same position in the front-rear direction along the drum axis 20A. In this state, in the plurality of toner replenishment units 5A, the first vertical conveyance pipe 52 or the third vertical conveyance pipe 54 is disposed at a different position in the front-rear direction along the drum axis 20A. In doing so, when each of the first vertical conveyance pipe pipes 52 is disposed at a different position in the front-rear direction, each of the third vertical conveyance pipes 54 is disposed at a same position in the front-rear direction. In addition, when each of the third vertical conveyance pipe pipes 54 is disposed at a different position in the front-rear direction, each of the first vertical conveyance pipes 52 is disposed at a same position in the front-rear direction.

The position deviation amount along the front-rear direction of each of the first vertical conveyance pipes 52 or each of the third vertical conveyance pipes 54 is set in accordance with the pitch deviation between the developing device pitch and the first container pitch, and is set to a larger value as the pitch deviation increases. As a result, the pitch deviation between the developing device pitch and the first container pitch is absorbed, and the angle θ formed by the first conveyance screw 58 and the second conveyance screw 59 disposed in a V shape can be made to coincide in the plurality of toner replenishment units 5A. Therefore, the configuration of the conveyance driver 70 for driving the first conveyance screw 58 and the second conveyance screw 59, for example, the first input gear 75 and the third transmission gear 79 including a conical gear can be standardized in the plurality of toner replenishment units 5A, and the cost can be reduced.

Next, in the second aspect according to the present modified embodiment, in each toner replenishment unit 5A, the first vertical conveyance pipe 52 and the second vertical conveyance pipe 53 are disposed at a same position in the front-rear direction along the drum axis 20A. Therefore, the upper toner container 50 that communicates with the first vertical conveyance pipe 52 and the lower toner container 51 that communicates with the second vertical conveyance pipe 53 are disposed at a same position in the front-rear direction along the drum axis 20A. Furthermore, in the plurality of toner replenishment units 5A, each of the first vertical conveyance pipes 52 and each of the second vertical conveyance pipes 53 are disposed at a same position in the front-rear direction along the drum axis 20A. That is, all the first vertical conveyance pipes 52 and the second vertical conveyance pipes 53 included in each of the plurality of toner replenishment units 5A are disposed at the same position in the front-rear direction along the drum axis 20A. Therefore, all the upper toner container 50 and the lower toner container 51 included in each of the plurality of toner replenishment units 5A are disposed at the same position in the front-rear direction along the drum axis 20A.

In addition, the pitch between the first vertical conveyance pipes 52 in the arrangement direction (right-left direction) or the pitch between the third vertical conveyance pipes 54 in the arrangement direction (right-left direction) is set to a different value between the adjacent toner replenishment units 5A. In doing so, if the pitch between the adjacent first vertical conveyance pipes 52 in the arrangement direction is set to a different value, the pitch between the adjacent third vertical conveyance pipes 54 in the arrangement direction is set to a same value. In addition, if the pitch between the adjacent third vertical conveyance pipes 54 in the arrangement direction is set to a different value, the pitch between the adjacent first vertical conveyance pipes 52 in the arrangement direction is set to a same value.

More specifically with reference to FIG. 10, a pitch PC1 between the first vertical conveyance pipes 52 in the first toner replenishment unit 5AY and the second toner replenishment unit 5AC, a pitch PC2 between the first vertical conveyance pipes 52 in the second toner replenishment unit 5AC and the third toner replenishment unit 5AM, and a pitch PC3 between the first vertical conveyance pipes 52 in the third toner replenishment unit 5AM and the fourth toner replenishment unit 5ABK are set to a different value. In this case, between the adjacent toner replenishment units 5A, the pitch between the upper toner containers 50 (first container pitch) is different in the arrangement direction, and the pitch between the lower toner containers 51 (second container pitch) is different in the arrangement direction. Alternatively, a pitch PD1 between the third vertical conveyance pipes 54 in the first toner replenishment unit 5AY and the second toner replenishment unit 5AC, a pitch PD2 between the third vertical conveyance pipes 54 in the second toner replenishment unit 5AC and the third toner replenishment unit 5AM, and a pitch PD3 between the third vertical conveyance pipes 54 in the third toner replenishment unit 5AM and the fourth toner replenishment unit 5ABK are set to a different value. In this case, the pitch between the adjacent developing devices 23 (developing device pitch) for each color is different in the arrangement direction.

The deviation amount along the arrangement direction of the pitch between the adjacent first vertical conveyance pipes 52 or the pitch between the adjacent third vertical conveyance pipes 54 is set in accordance with the pitch deviation between the developing device pitch and the first container pitch, and is set to a larger value as the pitch deviation increases. As a result, the pitch deviation between the developing device pitch and the first container pitch is absorbed, and the angle θ formed by the first conveyance screw 58 and the second conveyance screw 59 disposed in a V shape can be made to coincide in the plurality of toner replenishment units 5A. Therefore, the configuration of the conveyance driver 70 for driving the first conveyance screw 58 and the second conveyance screw 59, for example, the first input gear 75 and the third transmission gear 79 including a conical gear can be standardized in the plurality of toner replenishment units 5A, and the cost can be reduced.

The image forming apparatus 10 according to an embodiment of the present disclosure has been described in detail above. According to such a configuration, an image forming apparatus can be provided, by which, in each toner replenishment unit 5, the toner conveyed by the first conveyance screw 58 and the second conveyance screw 59 can be efficiently merged at the confluence section 57, and at the same time the conveyance driver 70 for driving the respective conveyance screws 58 and 59 an be standardized in the plurality of toner replenishment units 5. The present disclosure is not limited to this. The present disclosure can include, for example, the following modified embodiments.

In the above embodiment, an aspect of the upper toner container 50 and the lower toner container 51 has been described, in which the toner inside is conveyed by rotating the main body portion of the container. However, the toner container may include a rotatable toner conveyance member such as a screw inside.

In addition, the request for replenishing the toner from the developing device 23 referred to by the drive controller 801 in order to discharge the toner from the upper toner container 50 and the lower toner container 51 is not limited to the above aspect. The toner replenishment to the developing device 23 may be determined on the basis of other information such as the image information in the image forming apparatus 10 and the density information of a patch image on the intermediate transfer belt 141 of the intermediate transfer unit 14.

What is claimed is:

1. An image forming apparatus comprising:

a plurality of image forming units that include a photosensitive drum being able to rotate about a horizontally extending drum axis and a developing device supplying toner to the photosensitive drum, and to be arranged along an arrangement direction horizontally orthogonal to the drum axis; and a plurality of toner replenishment units provided corresponding to each of the plurality of image forming units that replenish toner to the developing device, each of the plurality of toner replenishment units comprising:

first and second containers being able to store toner inside and discharge the toner;

a first vertical conveyance pipe formed in a tubular shape having a peripheral wall surrounding a first vertical pipe axis extending vertically downward from the first container and that guide the toner discharged from the first container vertically downward along the first vertical pipe axis;

a second vertical conveyance pipe formed in a tubular shape having a peripheral wall surrounding a second vertical pipe axis extending vertically downward from the second container and that guide the toner discharged from the second container vertically downward along the second vertical pipe axis;

a first horizontal conveyance pipe formed in a tubular shape extending in a first horizontal direction intersecting the drum axis and the arrangement direction and including a first inflow port connected to a lower end of the first vertical conveyance pipe for toner to flow in;

a second horizontal conveyance pipe formed in a tubular shape extending in a second horizontal direction at an acute angle with respect to the first horizontal direction and including a second inflow port connected to a lower end of the second vertical conveyance pipe for toner to flow in;

a first conveyance member disposed in the first horizontal conveyance pipe so as to be able to rotate about a first horizontal rotation axis along the first horizontal direction, and to convey the toner that has flowed into the first horizontal conveyance pipe through the first inflow port to a downstream side by rotation;

a second conveyance member disposed in the second horizontal conveyance pipe so as to be able to rotate about a second horizontal rotation axis along the second horizontal direction, and to convey the toner that has flowed into the second horizontal conveyance pipe through the second inflow port to a downstream side by rotation;

a confluence section that communicates with a downstream side portion of the first horizontal conveyance pipe and a downstream side portion of the second horizontal conveyance pipe respectively, to receive the toner conveyed by the first conveyance member and the second conveyance member respectively inside, and to include a confluence discharge port discharging the received toner;

a third vertical conveyance pipe formed in a tubular shape having a peripheral wall surrounding a third vertical pipe axis extending vertically downward from the confluence discharge port and that guides the toner discharged from the confluence section through the confluence discharge port toward the developing device vertically downward along the third vertical pipe axis; and a conveyance driver that generates a driving force to rotate the first conveyance member and the second conveyance member, wherein in a plan view of the confluence section seen from a vertical direction, the confluence discharge port is disposed between the first horizontal rotation axis and the second horizontal rotation axis, and wherein a first inter-axis distance between the first horizontal rotation axis and the third vertical pipe axis and a second inter-axis distance between the second horizontal rotation axis and the third vertical pipe axis are set to take a different value.

2. The image forming apparatus according to claim 1, wherein the first container is disposed above the second container so as to overlap a part of the second container in a plan view seen from the vertical direction, wherein a length of the first vertical conveyance pipe along the first vertical pipe axis is set to a value longer than a length of the second vertical conveyance pipe along the second vertical pipe axis, and wherein the first inter-axis distance is set to a value shorter than the second inter-axis distance.

3. The image forming apparatus according to claim 1, the first conveyance member comprising:

a first shaft disposed on the first horizontal rotation axis and rotated by a driving force of the conveyance driver;

a first conveyance blade disposed on the first shaft and to convey the toner to the downstream side by rotation accompanying rotation of the first shaft; and a first paddle disposed in the confluence section on the downstream side of the first conveyance blade on the first shaft and to send out the toner conveyed from the first conveyance blade to the confluence discharge port by the rotation accompanying the rotation of the first shaft, the second conveyance member comprising:

a second shaft disposed on the second horizontal rotation axis and rotated by a driving force of the conveyance driver;

a second conveyance blade disposed on the second shaft and to convey the toner to the downstream side by rotation accompanying rotation of the second shaft; and a second paddle disposed in the confluence section on the downstream side of the second conveyance blade on the second shaft and to send out the toner conveyed from the second conveyance blade to the confluence discharge port by the rotation accompanying the rotation of the second shaft, wherein the first inter-axis distance is set to be equal to or less than a value obtained by adding a turning radius of the first paddle to an opening radius of the confluence discharge port, and wherein the second inter-axis distance is set to be equal to or less than a value obtained by adding a turning radius of the second paddle to the opening radius of the confluence discharge port.

4. The image forming apparatus according to claim 1, the conveyance driver comprising:

a motor being able to rotate in a first rotation direction and a second rotation direction opposite to the first rotation direction; and a swing gear that is able to swing between a first position and a second position in accordance with a rotation direction of the motor, to allow rotation of the first conveyance member at the first position, and to allow rotation of the second conveyance member at the second position.

5. The image forming apparatus according to claim 4, each of the toner replenishment units further comprising:

a first conveyance detection sensor that detects rotation of the first conveyance member; and a second conveyance detection sensor that detects rotation of the second conveyance member.

6. The image forming apparatus according to claim 4, each of the toner replenishment units further comprising a motor rotation detection sensor detecting the rotation of the motor.

7. The image forming apparatus according to claim 1, the conveyance driver comprising:

a motor being able to rotate in a first rotation direction and a second rotation direction opposite to the first rotation direction;

a first one-way clutch that allows rotation of the first conveyance member when the motor is rotated in the first rotation direction, and at the same time to regulate the rotation of the first conveyance member when the motor is rotated in the second rotation direction; and a second one-way clutch that allows rotation of the second conveyance member when the motor is rotated in the second rotation direction, and at the same time to regulate the rotation of the second conveyance member when the motor is rotated in the first rotation direction.

8. An image forming apparatus comprising:

a plurality of image forming units that include a photosensitive drum being able to rotate about a horizontally extending drum axis and a developing device supplying toner to the photosensitive drum, and to be arranged along an arrangement direction horizontally orthogonal to the drum axis; and a plurality of toner replenishment units provided corresponding to each of the plurality of image forming units and that replenish toner to the developing device, each of the plurality of toner replenishment units comprising:

first and second containers being able to store toner inside and discharge the toner;

a first vertical conveyance pipe formed in a tubular shape having a peripheral wall surrounding a first vertical pipe axis extending vertically downward from the first container and that guides the toner discharged from the first container vertically downward along the first vertical pipe axis;

a second vertical conveyance pipe formed in a tubular shape having a peripheral wall surrounding a second vertical pipe axis extending vertically downward from the second container and that guides the toner discharged from the second container vertically downward along the second vertical pipe axis;

a first horizontal conveyance pipe formed in a tubular shape extending in a first horizontal direction intersecting the drum axis and the arrangement direction and including a first inflow port connected to a lower end of the first vertical conveyance pipe for toner to flow in;

a second horizontal conveyance pipe formed in a tubular shape extending in a second horizontal direction at an acute angle with respect to the first horizontal direction and including a second inflow port connected to a lower end of the second vertical conveyance pipe for toner to flow in;

a first conveyance member disposed in the first horizontal conveyance pipe so as to be able to rotate about a first horizontal rotation axis along the first horizontal direction, and to convey the toner that has flowed into the first horizontal conveyance pipe through the first inflow port to a downstream side by rotation;

a second conveyance member disposed in the second horizontal conveyance pipe so as to be able to rotate about a second horizontal rotation axis along the second horizontal direction, and to convey the toner that has flowed into the second horizontal conveyance pipe through the second inflow port to a downstream side by rotation;

a confluence section that communicates with a downstream side portion of the first horizontal conveyance pipe and a downstream side portion of the second horizontal conveyance pipe respectively, to receive the toner conveyed by the first conveyance member and the second conveyance member respectively inside, and to include a confluence discharge port discharging the received toner;

a third vertical conveyance pipe formed in a tubular shape having a peripheral wall surrounding a third vertical pipe axis extending vertically downward from the confluence discharge port and that guides the toner discharged from the confluence section through the confluence discharge port toward the developing device vertically downward along the third vertical pipe axis; and a conveyance driver that generates a driving force to rotate the first conveyance member and the second conveyance member, wherein in a plan view of the confluence section seen from a vertical direction, the confluence discharge port is disposed between the first horizontal rotation axis and the second horizontal rotation axis, wherein a first inter-axis distance between the first horizontal rotation axis and the third vertical pipe axis and a second inter-axis distance between the second horizontal rotation axis and the third vertical pipe axis are set to a same value, and wherein the first vertical conveyance pipe or the third vertical conveyance pipe of each of the plurality of toner replenishment units is disposed at a different position in a direction along the drum axis.

9. An image forming apparatus comprising:

at least three image forming units that includes a photosensitive drum being able to rotate about a horizontally extending drum axis and a developing device supplying toner to the photosensitive drum, and to be arranged along an arrangement direction horizontally orthogonal to the drum axis; and at least three toner replenishment units provided corresponding to each of the at least three image forming units and that replenish toner to the developing device, each of the at least three toner replenishment units comprising:

first and second containers being able to store toner inside and discharge the toner;

a first vertical conveyance pipe formed in a tubular shape having a peripheral wall surrounding a first vertical pipe axis extending vertically downward from the first container and that guides the toner discharged from the first container vertically downward along the first vertical pipe axis;

a second vertical conveyance pipe formed in a tubular shape having a peripheral wall surrounding a second vertical pipe axis extending vertically downward from the second container and that guides the toner discharged from the second container vertically downward along the second vertical pipe axis;

a first horizontal conveyance pipe formed in a tubular shape extending in a first horizontal direction intersecting the drum axis and the arrangement direction and including a first inflow port connected to a lower end of the first vertical conveyance pipe for toner to flow in;

a second horizontal conveyance pipe formed in a tubular shape extending in a second horizontal direction at an acute angle with respect to the first horizontal direction and including a second inflow port connected to a lower end of the second vertical conveyance pipe for toner to flow in;

a first conveyance member disposed in the first horizontal conveyance pipe so as to be able to rotate about a first horizontal rotation axis along the first horizontal direction, and to convey the toner that has flowed into the first horizontal conveyance pipe through the first inflow port to a downstream side by rotation;

a second conveyance member disposed in the second horizontal conveyance pipe so as to be able to rotate about a second horizontal rotation axis along the second horizontal direction, and to convey the toner that has flowed into the second horizontal conveyance pipe through the second inflow port to a downstream side by rotation;

a confluence section that communicates with a downstream side portion of the first horizontal conveyance pipe and a downstream side portion of the second horizontal conveyance pipe respectively, receives the toner conveyed by the first conveyance member and the second conveyance member respectively inside, and includes a confluence discharge port discharging the received toner;

a third vertical conveyance pipe formed in a tubular shape has a peripheral wall surrounding a third vertical pipe axis extending vertically downward from the confluence discharge port and guides the toner discharged from the confluence section through the confluence discharge port toward the developing device vertically downward along the third vertical pipe axis; and a conveyance driver that generates a driving force to rotate the first conveyance member and the second conveyance member, wherein in a plan view of the confluence section seen from a vertical direction, the confluence discharge port is disposed between the first horizontal rotation axis and the second horizontal rotation axis, wherein a first inter-axis distance between the first horizontal rotation axis and the third vertical pipe axis and a second inter-axis distance between the second horizontal rotation axis and the third vertical pipe axis are set to a same value, and wherein in the at least three toner replenishment units, a pitch between the first vertical conveyance pipes adjacent to each other in the arrangement direction or a pitch between the third vertical conveyance pipes in the arrangement direction is set to a different value.

* * * * *